US007595140B2

(12) United States Patent
Akioka et al.

(10) Patent No.: US 7,595,140 B2
(45) **Date of Patent: *Sep. 29, 2009**

(54) LIQUID DEVELOPER AND IMAGE FORMING APPARATUS

(75) Inventors: Koji Akioka, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 324 days.

This patent is subject to a terminal disclaimer.

(21) Appl. No.: 11/677,991

(22) Filed: Feb. 22, 2007

(65) Prior Publication Data

US 2007/0248381 A1 Oct. 25, 2007

(30) Foreign Application Priority Data

Feb. 27, 2006 (JP) ..... 2006-050891
Nov. 21, 2006 (JP) ..... 2006-314883

(51) Int. Cl.
*G03G 9/125* (2006.01)

(52) U.S. Cl. ..... 430/116; 399/297

(58) Field of Classification Search ..... 430/116; 106/31.86; 399/297
See application file for complete search history.

(56) References Cited

U.S. PATENT DOCUMENTS

| | | | | |
|---|---|---|---|---|
| 3,718,593 | A | 2/1973 | Tamai | |
| 6,029,036 | A | 2/2000 | Itaya et al. | 399/239 |
| 6,207,336 | B1 | 3/2001 | Itaya et al. | 430/119 |
| 6,777,154 | B2 | 8/2004 | Takahashi et al. | |
| 2003/0143476 | A1 | 7/2003 | Takahashi et al. | |
| 2004/0259015 | A1 | 12/2004 | Tsubuko et al. | |
| 2007/0202432 | A1 * | 8/2007 | Akioka et al. | 430/115 |

FOREIGN PATENT DOCUMENTS

JP 07-152256 6/1995

* cited by examiner

*Primary Examiner*—John L Goodrow
(74) *Attorney, Agent, or Firm*—Hogan & Hartson LLP

(57) ABSTRACT

A liquid developer includes toner particles formed of a resin material and a coloring agent, and an insulation liquid in which the toner particles are dispersed, the insulation liquid containing ester-exchange oil obtained by an ester-exchange reaction of soybean oil and at least one of semidrying oil and nondrying oil. It is preferred that the insulation liquid further contains fatty acid monoester. Further, it is preferred that the amount of the fatty acid monoester contained in the insulation liquid is in the range of 5 to 50 wt %.

12 Claims, 5 Drawing Sheets

LIQUID DEVELOPER AND IMAGE FORMING APPARATUS

CROSS-REFERENCE TO RELATED APPLICATION

This application claims priorities to Japanese Patent Applications No. 2006-050891 filed on Feb. 27, 2006 and No. 2006-314883 filed on Nov. 21, 2006 which are hereby expressly incorporated by reference herein in their entireties.

BACKGROUND

1. Technical Field

The present invention relates to a liquid developer and an image forming apparatus.

2. Related Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof.

The other type of such a developer is known as a liquid developer which is obtained by dispersing toner particles into a carrier liquid having electric insulation properties (one example of such a liquid toner is disclosed in JP-A-7-152256).

In the developing method using such a dry toner, since a solid state toner is used, there is an advantage in handleability thereof. On the other hand, however, this method involves problems in that an adverse effect against a human body is likely to be caused by toner powder, contamination is likely to be caused by dispersal of toner powder, and toner particles are likely to be massed together in a cartridge.

Further, in such a dry toner, since aggregation of toner particles is likely to occur in the producing process thereof, it is difficult to obtain toner particles each having a sufficiently small diameter. This means that it is difficult to form a toner image having high resolution.

Furthermore, there is also a problem in that when the size of the toner particle is made to be relatively small, the problems resulted from the powder form of the dry toner described above become more serious.

On the other hand, in the developing method using the liquid developer, since aggregation of toner particles in the liquid developer is effectively prevented, it is possible to use very fine toner particles and it is also possible to use a binder resin having a low softening point (a low softening temperature).

As a result, the method using the liquid developer has such advantages as good reproductivity of an image composed of thin lines, good tone reproductivity as well as good reproductivity of colors. Further, the method using the liquid developer is also superior as a method for forming an image at high speed.

However, since the insulation liquid used in the conventional liquid developer is mainly composed of a petroleum-based carbon hydride, there is concern that the insulation liquid may give an adverse effect on the environment if it flows out of an image forming apparatus.

Further, normally, when a liquid developer is used, an insulation liquid is adhering to a surface of each toner particle during fixing process of the toner particles. Because of this, in the conventional liquid developer, there is a problem in that such an insulation liquid adhering to the surfaces of the toner particles lowers fixing strength of the toner particles.

In this regard, in order to improve the fixing strength of the toner particles, it may be conceived that the toner particles are heated in a long period of time at a relatively high temperature. However, this approach makes it difficult to satisfy recent demands required in the field of image formation such as higher speed image formation and image formation under energy saving.

SUMMARY

Accordingly, it is an object of the present invention to provide a liquid developer which is harmless to the environment and which also has excellent storage stability as well as superior fixing characteristic of toner particles, and an image forming apparatus using a liquid developer which is harmless to the environment and which also has excellent storage stability as well as superior fixing characteristic of toner particles.

A first aspect of the invention is directed to a liquid developer. The liquid developer comprises toner particles formed of a resin material and a coloring agent, and an insulation liquid in which the toner particles are dispersed, the insulation liquid containing ester-exchange oil obtained by an ester-exchange reaction of soybean oil and at least one of semidrying oil and nondrying oil.

In the liquid developer mentioned above, it is preferred that the insulation liquid further contains fatty acid monoester.

In the liquid developer mentioned above, it is preferred that the amount of the fatty acid monoester contained in the insulation liquid is in the range of 5 to 50 wt %.

In the liquid developer mentioned above, it is preferred that when X (wt %) represents the amount of the ester-exchange oil contained in the insulation liquid and Y (wt %) represents the amount of the fatty acid monoester contained in the insulation liquid, a relation of $1.0 \leqq X/Y \leqq 5.0$ is satisfied.

In the liquid developer mentioned above, it is preferred that the fatty acid monoester contains ester of fatty acid and alkylalcohol having 1 to 4 carbon atoms.

In the liquid developer mentioned above, it is preferred that the mixing ratio of the soybean oil and the semidrying oil in the ester-exchange reaction is in the range of 100:5 to 100:500 by weight.

In the liquid developer mentioned above, it is preferred that the mixing ratio of the soybean oil and the nondrying oil in the ester-exchange reaction is in the range of 100:5 to 100:300 by weight.

In the liquid developer mentioned above, it is preferred that the semidrying oil contains sunflower oil, rapeseed oil or safflower oil.

In the liquid developer mentioned above, it is preferred that the nondrying oil contains olive oil, castor oil or peanut oil.

In the liquid developer mentioned above, it is preferred that an iodine value of the insulation liquid is in the range of 30 to 220.

In the liquid developer mentioned above, it is preferred that the liquid developer further comprises an antioxidizing agent.

In the liquid developer mentioned above, it is preferred that the liquid developer further comprises an oxidation polymerization accelerator for accelerating an oxidation polymerization reaction of the ester-exchange oil.

In the liquid developer mentioned above, it is preferred that the oxidation polymerization accelerator is contained in the insulation liquid with being encapsulated.

A second aspect of the invention is directed to an image forming apparatus for forming an image onto a recording medium using the above liquid developer. The image forming apparatus comprises a liquid developer storage section for storing a liquid developer therein, a developing section for developing an image using the liquid developer supplied from the liquid developer storage section, an transfer section for transferring the image formed on the developing section onto a recording medium to form a transferred image thereon, and a fixing section for fixing the transferred image formed on the recording medium onto the recording medium, wherein the liquid developer comprises an insulation liquid containing ester-exchange oil obtained by an ester-exchange reaction of soybean oil and at least one of semidrying oil and nondrying oil, and toner particles dispersed in the insulation liquid.

According to the liquid developer mentioned above, it is possible to provide a liquid developer which is harmless to the environment and which also has excellent storage stability as well as superior fixing characteristic of toner particles. Further, according to the image forming apparatus mentioned above, it is possible to provide an image forming apparatus using a liquid developer which is harmless to the environment and which also has excellent storage stability as well as superior fixing characteristic of toner particles.

These and other objects, structures and effects of the present invention will be more apparent when the following detailed description of the preferred embodiments and the examples will be considered taken in conjunction with the appended drawings.

DESCRIPTION OF EXEMPLARY EMBODIMENTS

Figure 1:
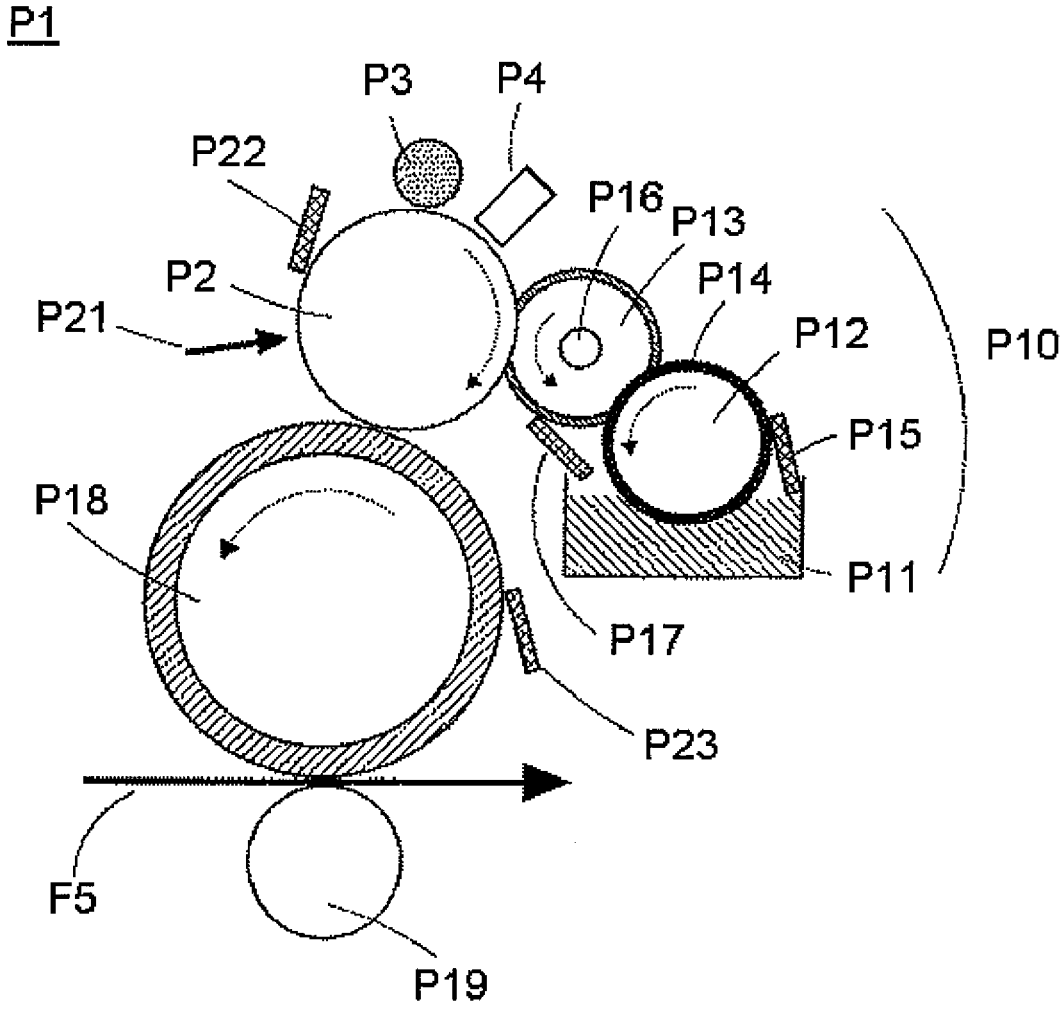
FIG. 1 is a cross sectional view which shows one example of a contact type liquid developing unit provided in an image forming apparatus according to the invention.

Hereinbelow, with reference to the accompanying drawings, preferred embodiments of a liquid developer and an image forming apparatus according to the invention will be described in details.

A liquid developer of the invention includes an insulation liquid and toner particles dispersed in the insulation liquid.

Insulation Liquid

First, a description will be made with regard to the insulation liquid. In the invention, the insulation liquid contains oil (ester-exchange oil) obtained by an ester-exchange reaction of soybean oil and at least one of semidrying oil and nondrying oil. Further, the insulation liquid preferably contains fatty acid monoester.

In this regard, the semidrying oil is oil containing an unsaturated fatty acid component and having an iodine value of 90 or high but lower than 120. On the other hand, the nondrying oil is oil having an iodine value of lower than 90. Further, the soybean oil is generally classified into drying oil (that is, oil having an iodine value of 120 or high).

The soybean oil, the semidrying oil and the nondrying oil are plant-derived oils, respectively. These oils are substances that are harmless to the environment. Therefore, in the case where these oils are used as the insulation liquid, it is possible to decrease a load to the environment by the insulation liquid which may be cased by leakage of the insulation liquid out of an image forming apparatus and discard of the used liquid developers.

Further, the soybean oil and the semidrying oil are components which can contribute to improvement of fixing characteristic of toner particles onto a recording medium. In particular, the soybean oil and the semidrying oil themselves are components which are cured due to an oxidation polymerization reaction (especially, by a heat or the like applied during the fixing process) to exhibit a function of improving the fixing characteristic of the toner particles.

However, in the case where these oils are used singly or in combination of them as the insulation liquid, there are such problems as follows. Namely, in the case where the soybean oil is used singly as the insulation liquid, the fixing strength can be improved, but storage stability of the liquid developer is reduced because the soybean oil is relatively easily oxidized and polymerized.

On the other hand, in the case where the semidrying oil is used singly as the insulation liquid, storage stability of the liquid developer can be improved sufficiently. However, a relatively high energy is required for curing the semidrying oil by the oxidation polymerization reaction, and a long time is required for progression of the oxidation polymerization reaction. This makes it impossible to fix the toner particles onto a recording medium at a low temperature, and to carry out a high-speed printing.

Further, it may be conceived that a mixture of the soybean oil, the semidrying oil and the nondrying oil is used as the insulation liquid. In this case, each of the oils cannot exhibit its feature in the liquid developer. Therefore, it has been difficult to obtain a liquid developer having both of excellent storage stability and superior fixing characteristic.

The present inventor has made extensive researches and studies for the insulation liquid. As a result, the inventor has found that it is possible to obtain a liquid developer which has both of excellent storage stability and superior fixing characteristic of toner particles by using ester-exchange oil, which is obtained by an ester-exchange reaction of the soybean oil and at least one of the semidrying oil and the nondrying oil, as a constituent of the insulation liquid.

Namely, according to the invention, by using the ester-exchange oil, which is obtained by the ester-exchange reaction of the soybean oil and at least one of the semidrying oil and the nondrying oil, as a constituent of the insulation liquid, it is possible to provide a liquid developer which has both of the excellent storage stability and the superior fixing characteristic of the toner particles onto a recording medium.

Further, the ester-exchange oil, which is obtained by the ester-exchange reaction of the soybean oil and at least one of the semidrying oil and the nondrying oil, is a substance that is harmless to the environment. Therefore, it is possible to decrease a load to the environment by the insulation liquid which may be cased by leakage of the insulation liquid out of the image forming apparatus and discard of the used liquid developers. As a result, it is also possible to provide a liquid developer which is harmless to the environment.

In this regard, the ester-exchange oil obtained by the ester-exchange reaction includes glycerin ester (triglyceride) which has a fatty acid component (unsaturated fatty acid component) contained in the soybean oil and a fatty acid component (unsaturated fatty acid component) contained in the semidrying oil and/or the nondrying oil in a molecule thereof.

In this way, according to the invention, a mere mixture of the soybean oil and the semidrying oil and/or the nondrying oil is not used as the insulation liquid, but the triglyceride, which has the fatty acid component contained in the soybean oil and the fatty acid component contained in the semidrying oil and/or the nondrying oil in a molecule thereof, is used as the insulation liquid. This makes it possible to exhibit the effects of the invention, namely, both of the excellent storage stability and the superior fixing characteristic of the toner particles onto a recording medium.

Examples of the semidrying oil include sunflower oil, rapeseed oil, safflower oil, cottonseed oil, sesame oil, corn oil, and the like. Among these oils, each of the sunflower oil, the rapeseed oil, and the safflower oil has the especially excellent storage stability during the storage or preservation thereof. Therefore, in the case where any one or more of these oils are used as the semidrying oil, it is possible to provide a liquid developer which has the especially excellent storage stability while maintaining the superior fixing characteristic.

On the other hand, examples of the nondrying oil include olive oil, castor oil, peanut oil, avocado oil and hazelnut oil, and the like. Among these oils, in the case where at least one of the olive oil, the castor oil and the peanut oil is used as the nondrying oil, the liquid developer can have especially excellent storage stability.

Further, it is preferred that an iodine value of each of the semidrying oil and the nondrying oil is smaller than that of the soybean oil, and the difference between the iodine value of the soybean oil and the iodine value of each of the semidrying oil and the nondrying oil is equal to or more than 20. This makes it possible for the liquid developer to have more excellent storage stability while maintaining the superior fixing characteristic.

In this regard, the above-mentioned ester-exchange reaction can be carried out by a known method. Examples of such a known method include a method of using an enzyme, a method of using heat under a catalyst, and the like.

In the case where the ester-exchange reaction of the soybean oil and the semidrying oil is carried out, the mixing ratio of the soybean oil and the semidrying oil is preferably in the range of 100:5 to 100:500 by weight, more preferably in the range of 100:10 to 100:200 by weight, and even more preferably in the range of 100:30 to 100:100 by weight. By setting the mixing ratio of the soybean oil and the semidrying oil within the above range, it is possible to provide a liquid developer which has especially excellent storage stability and superior fixing characteristic.

Further, in the case where the ester-exchange reaction of the soybean oil and the nondrying oil is carried out, the mixing ratio of the soybean oil and the nondrying oil is preferably in the range of 100:5 to 100:300 by weight, more preferably in the range of 100:10 to 100:150 by weight, and even more preferably in the range of 100:30 to 100:90 by weight. By setting the mixing ratio of the soybean oil and the nondrying oil within the above range, it is possible to provide a liquid developer which has especially excellent storage stability and superior fixing characteristic.

The amount of the ester-exchange oil contained in the insulation liquid is preferably 50 wt % or more, more preferably in the range of 50 to 80 wt %, and even more preferably in the range of 50 to 75 wt %. By setting the amount of the ester-exchange oil contained in the insulation liquid within the above range, it is possible to provide a liquid developer which has especially excellent storage stability and superior fixing characteristic.

Further, the insulation liquid preferably contains fatty acid monoester. Hereinbelow, the fatty acid monoester will be described. The fatty acid monoester is ester of fatty acid and monohydroxy alcohol.

The fatty acid monoester has an effect (plasticizer effect) for plasticizing the toner particles during the fixing process. In general, it is known that various kinds of esters have a plasticizer effect against resin components such as polyvinyl chloride and the like and the plasticizer effect is enhanced by heat.

Therefore, ester compounds such as fatty acid monoester, ester-exchange oil, fatty acid triglyceride and the like can plasticize a resin component (resin material) contained in the toner particles due to heat applied during the fixing process. As a result, the ester compounds can plasticize the toner particles as a whole during the fixing process.

Among these ester compounds, the fatty acid monoester has a relatively small molecular weight. Therefore, the fatty acid monoester can be easily included in the resin component contained in the toner particles to thereby exhibit the plasticizer effect especially effectively. For this reason, the fatty acid monoester can plasticize the toner particles during the fixing process more reliably.

As a result, when the toner particles are subjected to heating and pressing on a recording medium during the fixing process, the fatty acid monoester, which exists in the vicinity of the surfaces of the toner particle, is easily impregnated into the toner particles so that the toner particles are easily plasticized due to the fatty acid monoester. The thus plasticized toner particles can adhere tightly to the recording medium.

Further, since the fatty acid monoester is also a component which is easily impregnated into a recording medium, the fatty acid monoester adhering to the surfaces of the toner particles is immediately impregnated into the recording medium when the toner particles make contact with the recording medium during the fixing process.

Further, the fatty acid monoester has a high affinity against the resin component contained in the toner particles. Therefore, when the fatty acid monoester itself is impregnated into the recording medium, the fatty acid monoester drags a part of each toner particle (that is, the resin component contained in the toner particles), which has been plasticized by the plasticizer effect and fused by heat upon fixation, into the recording medium.

Namely, a part of the resin component is also impregnated into the recording medium together with the fatty acid monoester. The impregnated resin component exhibits an anchoring effect against the recording medium to thereby further enhance the fixing strength of the toner particles against the recording medium.

Furthermore, since the fatty acid monoester also has a high affinity against the ester-exchange oil. Therefore, when the fatty acid monoester itself is impregnated into the recording medium, the fatty acid monoester also drags a part of the ester-exchange oil existing in the vicinity of the surfaces of the toner particles into the recording medium.

Namely, a part of the ester-exchange oil existing in the vicinity of the surfaces of the toner particles is also impregnated into the recording medium together with the fatty acid monoester. Then the impregnated ester-exchange oil is oxidized and polymerized (oxidatively polymerized) inside the recording medium so that oxidation polymerization products thereof are produced within the recording medium.

Therefore, the impregnated resin component into the recording medium can be fixed onto the recording medium due to these oxidation polymerization products. As a result, the toner particles are fixed onto the recording medium more firmly.

For these reasons, the liquid developer using the insulation liquid containing the fatty acid monoester can have the especially superior fixing characteristic of the toner particles onto a recording medium. Further, since the fatty acid monoester can plasticize the toner particles at a relatively low temperature, the liquid developer using the insulation liquid containing the fatty acid monoester can have the sufficient fixing characteristic of the toner particles onto a recording medium even in a low temperature region.

Furthermore, since the toner particles can be plasticized during the fixing process sufficiently, the plasticized toner particles are reliably fused with each other by contact between them. Therefore, in the case where an image is formed using a plurality of color toner particles, the adjacent different color particles are fused reliably.

Therefore, in a region of a recording medium where the different color particles are fused, a plurality of colors derived from the different color particles are mixed so that the region can take on an intermediate color of the plurality of colors reliably. As a result, in the case where an image having a plurality of colors is formed by using the above liquid developer, a desired color tone of the image can be obtained more reliably.

Moreover, since the fatty acid monoester is a component which is harmless to environment, it is possible to decrease a load to the environment by the insulation liquid which may be cased by leakage of the insulation liquid out of the image forming apparatus and discard of the used liquid developers. As a result, it is possible to provide a liquid developer which is harmless to the environment.

A viscosity of the fatty acid monoester is 10 mPa·S or less, and more preferably 5 mPa·S or less. In this regard, it is to be noted that in this specification, the viscosity is a value which is measured at 25° C. In this way, by setting the viscosity of the fatty acid monoester to a sufficient low range, the fatty acid monoester can be impregnated into the recording medium more effectively. Therefore, the impregnated fatty acid monoester can more reliably drag a part of the resin component of the toner particles plasticized by the plasticizer effect and fused by heat upon fixation, and a part of the ester-exchange oil existing in the vicinity of the surfaces of the toner particles into the recording medium. As a result, the above-mentioned anchoring effect is achieved more reliably so that the fixing characteristic of the toner particles onto a recording medium can be improved.

The amount of the fatty acid monoester contained in the insulation liquid is preferably in the range of 5 to 50 wt %, more preferably in the range of 10 to 45 wt %, and even more preferably in the range of 20 to 45 wt %. If the amount of the fatty acid monoester is the above lower limit value or more, since the absolute amount of the fatty acid monoester contained in the insulation liquid is sufficiently high, it becomes possible for the fatty acid monoester to have a great chance of adhering on the surfaces of the toner particles. As a result, the plasticizer effect against the toner particles due to the fatty acid monoester is achieved more effectively so that the resin component of the toner particles can be impregnated into the recording medium more reliably.

Further, since the absolute amount of the fatty acid monoester contained in the insulation liquid is sufficiently high, the ester-exchange oil can be impregnated into the recording medium more reliably together with the fatty acid monoester. For these reasons, the above-mentioned anchoring effect is achieved more reliably so that the fixing characteristic of the toner particles onto a recording medium can be improved, namely the fixing strength of the formed toner image can be made especially excellent.

Furthermore, since the toner particles can be plasticized during the fixing process sufficiently, the plasticized toner particles are reliably fused with each other by contact between them. As a result, a toner image having especially excellent glaze can be formed.

Further in the case where an image is formed using a plurality of color toner particles, the adjacent different color particles are fused reliably. Therefore, in a region of a recording medium where the different color particles are fused, a plurality of colors derived from the different color particles are mixed so that the region can take on an intermediate color of the plurality of colors reliably. As a result, in the case where an image having a plurality of colors is formed by using the above liquid developer, a desired color tone of the image can be obtained more reliably.

On the other hand, if the amount of the fatty acid monoester is the above upper limit value or less, since the absolute amount of the fatty acid monoester contained in the insulation liquid is proper amount, deterioration of parts or components provided in a liquid developing unit as described below can be prevented. This makes it possible to extend the life of the liquid developing unit and to also offer a broader choice of materials for the parts or components.

In contrast, if the amount of the fatty acid monoester is less than the above lower limit value, there is a case that the effects to be obtained due to the fatty acid monoester, namely the effect that the fatty acid monoester drags apart of the ester-exchange oil and the resin component of the toner particles into the recording medium and/or the effect that the fatty acid monoester plasticizes the toner particles are not obtained, depending on the composition of the liquid developer.

For example, if the toner particles cannot be plasticized sufficiently, there is a case that the resin component of the toner particles cannot enter into gaps between paper fibers of a paper used as a recording medium. In this case, there is a fear that a desired anchoring effect is not sufficiently obtained.

Further, if the amount of the fatty acid monoester is less than the above lower limit value, there is a case that the viscosity of the insulation liquid becomes too high, depending on the composition of the insulation liquid. In such a case, there is a fear that the fatty acid monoester and the ester-exchange oil cannot suitably be impregnated into the recording medium. In this case, there is a fear that the ester-exchange oil cannot make contact with the sufficient amount of oxygen which is need for the oxidation polymerization reaction thereof so that the oxidation polymerization reaction thereof does not progress effectively.

As a result, there is a case that the improvement of the anchoring effect due to the above oxidation polymerization products is not achieved sufficiently so that the fixing characteristic of the liquid developer (that is, the fixing characteristic of the toner particles onto a recording medium) is not improved.

On the other hand, if the amount of the fatty acid monoester exceeds the above upper limit value, there is a case that the fatty acid monoester is impregnated into the toner particles during the storage or preservation of the liquid developer so that the toner particles are unintentionally plasticized due to the fatty acidmonoester. In this case, there is a fear that the toner particles are brought into an agglutination or the like so that preservability of the liquid developer is lowered.

It is to be noted that in this specification, the period represented by the term "during the storage or preservation of the liquid developer" includes a state that the liquid developer is being put in an image forming apparatus before it is used for image fomation. Examples of such a state include a state that the image forming apparatus is not operated and a state of an idling of the image forming apparatus.

Further, if the amount of the fatty acid monoester exceeds the above upper limit value, there is a case that the fatty acid monoester is impregnated into parts or components, which are provided in a liquid developing unit, such as a developing roller, a blade and the like during the storage or preservation of the liquid developer, depending on a material constituting each of the parts or components. In this case, the parts or components may be swelled or eroded to thereby be deteriorated. Therefore, there is a fear that a material constituting each of the parts or components, which are provided in a liquid developing unit (an image forming apparatus), can not be selected freely.

The mixing ratio of the ester-exchange oil and the fatty acid monoester contained in the insulation liquid is not particularly limited, but preferably satisfies the following relation. Namely, when the amount of the ester-exchange oil contained in the insulation liquid is defined as X [wt %] and the amount of the fatty acid monoester contained in the insulation liquid is defined as Y [wt %], it is preferred that the relation of $1.0 \leqq X/Y \leqq 5.0$ is satisfied, more preferably the relation of $1.2 \leqq X/Y \leqq 4.5$ is satisfied, and even more preferably the relation of $1.5 \leqq X/Y \leqq 4.5$ is satisfied. By satisfying such relationship, it is possible to make the preservability of the liquid developer more excellent and also make the fixing strength of the toner particles onto a recording medium particularly excellent.

No particular limitation is imposed on the kinds of the fatty acid monoester that can be used in the liquid developer of the present invention. Examples of such fatty acid monoester include unsaturated fatty acid alkyl monoester, saturated fatty acid alkyl monoester, and the like. Here, "alkyl" includes methyl, ethyl, propyl, butyl, and the like. These fatty acid monoesters can be used singly or in combination of two or more of them.

In this regard, examples of the unsaturated fatty acid include oleic acid, palmitoleic acid, recinoleic acid, linoleic acid, α-linolenic acid, γ-linolenic acid, arachidonic acid, docosahexaenoic acid (DHA), eicosapentaenoic acid (EPA), and the like. On the other hand, examples of the saturated fatty acid include butyric acid, caproic acid, caprylic acid, capric acid, lauric acid, myristic acid, palmitic acid, stearic acid, arachidic acid, behenic acid, lignoceric acid, and the like.

As for such fatty acid monoester, it is preferred to use unsaturated fatty acid monoester having an unsaturated fatty acid component as its fatty acid component. The unsaturated fatty acid component is a component that can contribute to improving fixing properties of toner particles against a recording medium.

More specifically, unsaturated fatty acid monoester itself is cured during the fixing process due to its oxidation polymerization, and therefore it is possible to especially enhance the fixing strength of the toner particles onto the recording medium. As a result, since not only unsaturated fatty acid glyceride being impregnated into the recording medium, but also unsaturated fatty acid monoester can contribute to the oxidation polymerization, the especially excellent fixing strength can be obtained.

In addition, the unsaturated fatty acid monoester also exhibits the plasticizer effect during the fixing process as described above. As a result, the above-mentioned effects act synergistically, to thereby obtain the especially superior fixing characteristic of the liquid developer.

The amount of the unsaturated fatty acid component contained in all the fatty acid components of the fatty acid monoester is preferably 50 wt % or more, and more preferably 60 wt % or more. With this result, the above described effects can be exhibited more reliably and therefore especially high fixing strength can be obtained.

Further, it is preferred that the fatty acid component of the fatty acid monoester is mainly comprised of unsaturated fatty acid, but it may contain saturated fatty acid as a part thereof. This makes it possible to further improve preservability and storage stability of the insulation liquid.

The fatty acid monoester is ester of fatty acid and monohydroxy alcohol, wherein preferably the alcohol is alkyl alcohol having a carbon number of 1 to 4. By using such ester, chemical stability of the liquid developer can be made excellent and preservability and storage stability of the liquid developer can also be made more excellent.

Further, this also makes it possible to set the viscosity of the insulation liquid appropriately so that the liquid developer can be impregnated into a recording medium suitably. Examples of such alcohol include methanol, ethanol, propanol, butanol, isobutanol, and the like.

In this regard, it is more preferable that the fatty acid monoester contained in the insulation liquid is one obtained by an ester-exchange reaction of fatty acid glyceride and monohydroxy alcohol having a carbon number of 1 to 4. By using such fatty acid monoester, it is possible to increase compatibility between the fatty acid monoester and the fatty acid glyceride (ester-exchange oil).

Therefore the viscosity of the insulation liquid is set more appropriately so that the liquid developer can be impregnated into a recording medium more suitably. As a result, since fixing strength of toner particles against a recording medium can be made excellent, a liquid developer containing such an insulation liquid can be preferably used for image formation at a high speed.

Furthermore, the liquid developer (insulation liquid) may further contain an antioxidizing agent for preventing or controlling oxidation of the ester-exchange oil and the fatty acid monoester contained in the insulation liquid. This makes it possible to prevent the undesirable oxidation of the ester-exchange oil and the fatty acid monoester in the liquid developer.

As a result, it becomes possible to prevent the deterioration over time and the like of the liquid developer (insulation liquid) and keep the dispersibility of the toner particles and the fixing characteristic onto a recording medium of the toner particles particularly excellent for a long period of time. Namely, the storage stability of the liquid developer can be made particularly excellent.

Examples of such an antioxidizing agent include a vitamin E such as tocopherol, d-tocopherol, d1-α-tocopherol, acetic acid-α-tocopherol, acetic acid d1-α-tocopherol, tocopherol acetate, and α-tocopherol, a vitamin C such as dibutyl hydroxy toluene (BHT), butyl hydroxy anisole, ascorbic acid, ascorbic acid salts (ascorbate), and ascorbate stearic acid ester, green tea extract, green coffee bean extract, and the like. These antioxidizing agents may be used singly or in combination of two or more of them.

Further, among these substances, when dibutyl hydroxy toluene (BHT) is used, an oxidation of the ester-exchange oil and the fatty acid monoester can be prevented especially effectively. Further, oxidative product produced by oxidation of the dibutyl hydroxy toluene gives only small effects on the liquid developer. As a result, it can make the storage stability of the liquid developer and the fixing characteristic onto a recording medium of the toner particles particularly excellent.

Further, among these substances, when a vitaminE is used, it is possible to obtain the following effects. Namely, a vitamin E is a substance which is harmless to the environment, and its oxidative product produced by oxidation thereof gives only small effects on the liquid developer, and thus it is possible to obtain a liquid developer which is more harmless to the environment.

Further, since a vitamin E is a substance having high dispersibility in the above-mentioned insulation liquid, it can be used as the antioxidizing agent preferably. As a result, the storage stability of the liquid developer and the fixing characteristic of the toner particles onto a recording medium can be made especially excellent.

Further, among the substances mentioned above, when a vitamin C is used, it is possible to obtain the following effects. Namely, as is the same with the vitamin E described above, a vitamin C is a substance which is harmless to the environment, and its oxidative product produced by oxidation thereof gives only small effects on the liquid developer, and thus it is possible to obtain a liquid developer which is more harmless to the environment.

Further, since a vitamin C is a substance having a relatively low pyrolysis temperature, it can exhibit a function as the antioxidizing agent sufficiently during the storage or preservation of the liquid developer while the function as the antioxidizing agent is lowered during the fixing process so that the oxidation polymerization reaction of the ester-exchange oil and the fatty acid monoester is promoted.

It is preferred that the pyrolysis temperature of the antioxidizing agent is lower than the fixing temperature during the fixing process. This makes it possible to prevent deterioration of the insulation liquid during the preservation or storage of the liquid developer more effectively.

Further, the antioxidizing agent contained in the insulation liquid adhering to the surfaces of the toner particles are thermally decomposed during the fixing process, whereby enabling the ester-exchange oil and the fatty acid monoester to be cured through the oxidation polymerization reaction effectively. As a result, it becomes possible to make the fixing characteristic of the toner particles onto a recording medium sufficiently superior.

The pyrolysis temperature of the antioxidizing agent is preferably equal to or lower than 200° C., and more preferably equal to or lower than 180° C. This makes it possible for the antioxidizing agent to exhibit its function sufficiently. Further, it is also possible to improve the fixing strength of the toner particles effectively.

The amount of the antioxidizing agent contained in the insulation liquid is preferably in the range of 0.01 to 5 parts by weight with respect to 100 parts by weight of the insulation liquid, more preferably in the range of 0.1 to 4 parts by weight, and even more preferably in the range of 1 to 3 parts by weight.

This makes it possible to promote the oxidation polymerization reaction (curing) of the ester-exchange oil and the fatty acid monoester effectively when needed (that is, during the fixing process) while preventing the deterioration of the liquid developer caused by the oxidation of the ester-exchange oil during the preservation or storage of the liquid developer.

Further, the liquid developer may contain an oxidation polymerization accelerator (curing accelerator) for accelerating the oxidation polymerization reaction (curing reaction) of the ester-exchange oil and the fatty acid monoester described above.

This makes it possible to cure the ester-exchange oil and the fatty acid monoester through the oxidation polymerization reaction effectively when needed (that is, during the fixing process of the toner particles). As a result, the fixing strength of the toner particles when they are fixed onto a recording medium can be made particularly excellent.

In the case where the liquid developer contains an oxidation polymerization accelerator, it is preferred that the oxidation polymerization accelerator does not substantially accelerate the oxidation polymerization reaction of the ester-exchange oil and the fatty acid monoester during the storage or preservation of the liquid developer whereas it accelerates the oxidation polymerization reaction (curing) of the ester-exchange oil and the fatty acid monoester when needed (that is, during the fixing process of the toner particles).

This makes it possible to make the storage stability of the liquid developer excellent and also make the fixing strength of the toner particles onto a recording medium particularly excellent.

Examples of such an oxidation polymerization accelerator include a substance which has a function for accelerating the oxidation polymerization reaction (curing reaction) of the ester-exchange oil and the fatty acid monoester under application of heat whereas which does not accelerate the oxidation polymerization reaction (curing reaction) of the ester-exchange oil and the fatty acid monoester at around room temperature.

Namely, a substance in which activation energy for the oxidation polymerization reaction (curing reaction) of the ester-exchange oil and the fatty acid monoester is relatively high can be used as the oxidation polymerization accelerator.

Examples of such a substance include various kinds of metal salts of fatty acids and the like. These substances can be used singly or in combination of two or more of them. By using such an oxidation polymerization accelerator, it is possible to promote the oxidation polymerization reaction of the ester-exchange oil and the fatty acid monoester during the fixing process while maintaining the storage stability of the liquid developer.

Since metal salts of fatty acids can accelerate the oxidation polymerization reaction by supplying oxygen during the fixing process, it is possible to accelerate the oxidation polymerization reaction of the ester-exchange oil and the fatty acid monoester under the application of heat (e.g. during fixing process) effectively.

Therefore, it is possible to accelerate the oxidation polymerization reaction of the ester-exchange oil and the fatty acid monoester more effectively during the fixing process while preventing the oxidation polymerization reaction of the ester-exchange oil and the fatty acid monoester during the preservation or storage of the liquid developer more reliably.

Further, since metal salts of fatty acids have higher dispersibility in the ester-exchange oil, it is possible to disperse the metal salts of fatty acids into the insulation liquid homogeneously. With this result, it is possible to accelerate the oxidation polymerization reaction effectively as a whole during the fixing process.

Examples of such metal salts of fatty acids include metal salts of a resin acid (e.g. a cobalt salt, a manganese salt, and a lead salt thereof), metal salts of a linolenic acid (e.g. a cobalt salt, a manganese salt, and a lead salt thereof), metal salts of an octylic acid (e.g. a cobalt salt, a manganese salt, a lead salt, a zinc salt, and a calcium salt thereof), metal salts of a naphthenic acid (e.g. a zinc salt and a calcium salt thereof). These metal salts of fatty acids may be used singly or in combination of two or more of them.

The oxidation polymerization accelerator may be contained in the insulation liquid with being encapsulated. Such an encapsulated oxidation polymerization accelerator does not substantially accelerate the oxidation polymerization reaction of the ester-exchange oil and the fatty acid monoester during the preservation or storage of the liquid developer whereas it accelerates the oxidation polymerization reaction (curing) of the ester-exchange oil and the fatty acid monoester during the fixing process of the toner particles.

Namely, it is possible to prevent the oxidation polymerization reaction from being caused during the preservation or storage of the liquid developer more reliably. Further, since the capsules of the oxidation polymerization accelerator are collapsed with a predetermined pressure applied at the fixing process to thereby cause contact between the oxidation polymerization accelerator, and the ester-exchange oil and the fatty acid monoester, it is possible to accelerate the oxidation polymerization reaction of the ester-exchange oil and the fatty acid monoester reliably.

Further, the use of the encapsulated oxidation polymerization accelerator offers a broader choice of materials for the oxidation polymerization accelerator. In other words, even an oxidation polymerization accelerator having high reactivity (an oxidation polymerization accelerator which can accelerate the oxidation polymerization reaction of the ester-exchange oil and the fatty acid monoester at a relatively low temperature) can be used and it can make the fixing strength of the toner particles onto a recording medium particularly excellent.

The amount of the oxidation polymerization accelerator contained in the insulation liquid is preferably in the range of 0.01 to 10 parts by weight with respect to 100 parts by weight of the insulation liquid, more preferably in the range of 0.05 to 7 parts by weight, and even more preferably in the range of 0.1 to 5 parts by weight.

This makes it possible to accelerate the oxidation polymerization reaction of the ester-exchange oil and the fatty acid monoester during the fixing process more reliably while preventing oxidation polymerization reaction from being caused during the preservation or storage of the liquid developer sufficiently.

Further, the insulation liquid may contain additional components other than the above-mentioned components. Examples of the additional components include mineral oils such as ISOPER E, ISOPER G, ISOPER H, ISOPER L ("ISOPER" is a product name of Exxon Mobil Chemical), SHELLSOL 70, SHELLSOL 71 ("SHELLSOL" is a product name of Shell Chemical Japan Ltd.), Amsco OMS, Amsco 460 solvent ("Amsco" is a product name of Spirit Co., Ltd.), low-viscosity or high-viscosity liquid paraffin (produced by Wako Pure Chemical Industries, Ltd.), and the like, saturated fatty acid glyceride, glycerine, degradation products of fatty acid glyceride (e.g. fatty acid and the like), octane, isooctane, decane, isodecane, decalin, nonane, dodecane, isododecane, cyclohexane, cyclooctane, cyclodecane, benzene, toluene, xylene, mesitylene, and the like. These additional components may be used singly or in combination of two or more of them.

The electric resistance of the insulation liquid described above at room temperature (20° C.) is preferably equal to or higher than $1\times10^{9}$ Ωcm, more preferably equal to or higher than $1\times10^{11}$ Ωcm, and even more preferably equal to or higher than $1\times10^{13}$ Ωcm. Further, the dielectric constant of the insulation liquid is preferably equal to or lower than 3.5.

Furthermore, an iodine value of the insulation liquid is, but not limited thereto, preferably in the range of 30 to 220, and more preferably in the range of 80 to 220. This makes it possible to accelerate the oxidation polymerization reaction of the ester-exchange oil and the fatty acid monoester effectively while preventing the chemical deterioration of the insulation liquid sufficiently and to improve the fixing strength of the toner particles when they are fixed onto a recording medium.

Toner Particles

Hereinbelow, a description will be made with regard to the toner particles. The toner particles (toner) contained in the liquid developer of the invention comprises at least a binder resin (resin material) and a coloring agent.

1. Resin Material (Binder Resin)

Toner particles contained in a liquid developer are constituted from a material which contains a resin material (resin) as its main component.

In the invention, there is no specific limitation on the kinds of a resin (binder resin) to be used. Examples of such a resin (binder resins) include styrene-based resins (homopolymers or copolymers containing styrene or a styrene substituent) such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic ester copolymer, styrene-acrylic ester-methacrylic ester copolymer, styrene-α-methyl chloroacrylate copolymer, styrene-acrylonitrile-acrylic ester copolymer, and styrene-vinyl methyl ether copolymer, polyester-based resins, epoxy resins, urethane-modified epoxy resins, silicone-modified epoxy resins, vinyl chloride resins, rosin-modified maleic acid resins, phenyl resins, polyethylene-based resins, polypropylene, ionomer resins, polyurethane resins, silicone resins, ketone resins, ethylene-ethylacrylate copolymer, xylene reins, polyvinyl butyral resins, terpene reins, phenol resins, and aliphatic or alicyclic hydrocarbon resins. These binder resins can be used singly or in combination of two or more of them.

Among these resins, since the polyester-base resins have a high affinity to the above-mentioned ester-exchange oil and fatty acid monoester, it is possible to make dispersibility of the toner particles in the liquid developer particularly excellent. Further, since the polyester-base resins have a high transparency, in the case where the polyester-base resins are used as the binder resin, color development of an obtained image becomes excellent.

The softening point of the resin (resin material) is not particularly limited to any specific value, but it is preferably in the range of 50 to 130° C., more preferably in the range of 50 to 120° C., and even more preferably in the range of 60 to 115° C. In this specification, the term "softening point" means a temperature at which softening is begun under the conditions that a temperature raising speed is 5° C./mim and a diameter of a die hole is 1.0 mm in a high-floored flow tester (manufactured by Shimadzu Corporation).

2. Coloring Agent

The toner particles of the liquid developer also contain a coloring agent. As for a coloring agent, pigments, dyes or the like can be used. Examples of such pigments and dyes include Carbon Black, Spirit Black, Lamp Black (C.I. No. 77266), Magnetite, Titanium Black, Chrome Yellow, Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

3. Other Components

In the toner particles, additional components other than the above components may be contained. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty acid ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Further, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the toner (toner particles) may further contain zinc stearate, zincoxide, cerium oxide, silica, titaniumoxide, iron oxide, aliphatic acid, or aliphatic metal salt, or the like in addition to the components described above.

Shape of Toner Particles

The average particle size (diameter) of the toner particles constituted from the above described materials is preferably in the range of 0.1 to 5 μm, more preferably in the range of 0.1 to 4 μm, and even more preferably in the range of 0.5 to 3 μm. If the average particle size of the toner particles is within the above range, variations in properties of the toner particles can be made sufficiently small. Consequently, it is possible to make resolution of a toner image formed from the liquid developer (liquid toner) sufficiently high so that the liquid developer can have high reliability as a whole.

Further, it is preferred that a standard deviation of particle size among the toner particles contained in the liquid developer is 1.0 μm or less, more preferably in the range of 0.1 to 1.0 μm, and even more preferably in the range of 0.1 to 0.8 μm. When the standard deviation of particle size lies within the above range, variations in properties of the toner particles can be made especially small, thereby further improving the reliability of the liquid developer as a whole.

Furthermore, it is also preferred that an average roundness R represented by the following formula (I) is 0.85 or higher, more preferably in the range of 0.90 to 0.99, and even more preferably 0.92 to 0.99.

$$R=L_0/L_1 \quad \text{(I)}$$

wherein $L_1$ (μm) represents the circumference of projected image of a toner particle that is a subject of measurement, and $L_0$ (μm) represents the circumference of a perfect circle (a geometrically perfect circle) having the same area as that of the projected image of the toner particle that is a subject of measurement.

When the average roundness R of the toner particles is within the above range, the transfer efficiency and the mechanical strength of the toner particles can be made excellent while the particle size of the toner particles can be made sufficiently small.

In this case, it is preferred that a standard deviation of the average roundness among the toner particles is 0.15 or less, more preferably in the range of 0.001 to 0.10, and even more preferably 0.001 to 0.05. When the standard deviation of average roundness among the toner particles lies within the above range, variations in electrification properties, fixing properties, etc are especially small, thereby further improving the reliability of the liquid developer as a whole.

The liquid developer as described above may be formed by various methods. For example, in one method, a toner material is milled by a milling method to obtain toner particles, and then the toner particles are dispersed in an insulation liquid to thereby obtain a liquid developer. In another method, a liquid developer is manufactured using a dispersion liquid obtained by dispersing a toner material into a dispersion medium (see, for example, JP-A 2004-370231).

Next, a description will be made with regard to preferred embodiments of an image forming apparatus to which a liquid developer of the invention can be used. The image forming apparatus comprises a liquid developing unit for forming a toner image onto a recording medium, and a fixing unit for fixing the toner image formed on the recording medium onto the recording medium.

FIG. 1 is a cross sectional view which shows one example of a contact type liquid developing unit provided in an image forming apparatus according to the invention. The liquid developing unit P1 includes a developer container (liquid developer storage section) P11, a photoreceptor P2 in the form of a cylindrical drum, a developer P10, and an intermediate transfer roller P18.

A liquid developer is stored in the developer container P11. An image (toner image) is developed onto the photoreceptor P2. Further, the developer P10 supplies the liquid developer from the developer container P11 to the photoreceptor P2.

The intermediate transfer roller P18 transfers the image developed on photoreceptor P2 onto a recording medium so that a transferred image (toner image) is formed on the recording medium.

The liquid developing unit (liquid developing section) P1 includes a photoreceptor P2 in the form of a cylindrical drum. After the surface of the photoreceptor P2 is uniformly charged with a charging device P3 made of an epichlorohydrin rubber or the like, exposure corresponding to the information to be recorded is carried out using a line head exposure section P4 having organic EL elements or the like so that an electrostatic latent image is formed.

The developer P10 has an application roller P12 a part of which is immersed in a developer container P11 and a development roller P13. The application roller P12 is formed form, for example, a gravure roller made of stainless steel or the like, which rotates with opposing to the development roller P13. On the surface of the application roller P12, a liquid developer application layer P14 is formed, and the thickness of the layer is adapted to be kept constant by a metering blade P15.

Further, a liquid developer is transferred from the application roller P12 to the development roller P13. The development roller P13 is constructed from a metallic roller core member P16 made from stainless steel or the like, a low hardness silicone rubber layer provided on the metallic core member P16, and a resin layer made of a conductive PFA (polytetrafluoroetylene-perfluorovinylether copolymer) formed on the silicone rubber layer.

The development roller P13 is adapted to rotate at the same speed as the photoreceptor P2 to transfer the liquid developer to a latent image section. A part of the liquid developer remaining on the development roller P13 after it has been transferred to the photoreceptor P2 is removed by a development roller cleaning blade P17 and then collected in the developer container P11.

In this regard, it is to be noted that the photoreceptor P2, the developer P10, and other related elements constitute a developing section for developing a toner image using the liquid developer supplied from the liquid developer storage section.

Further, after a image (toner image) is transferred from the photoreceptor P2 to an intermediate transfer roller P18, the photoreceptor P2 is discharged with discharging light P21, and a toner which has not been transferred and remains on the photoreceptor P2 is removed by a cleaning blade P22 made of a urethane rubber or the like.

The image (toner image) formed on the photoreceptor P2 is transferred to the intermediate transfer roller P18. Then, a transfer current is supplied to a secondary transfer roller P19, and the toner image transferred on the intermediate roller P18 is transferred onto the recording medium F5 which passes between the intermediate transfer rollers P18 and the secondary transfer roller P19.

Namely, the intermediate transfer roller P18, the secondary transfer roller P19, and other related elements constitute an transfer section for transferring the image formed on the developing section onto a recording medium to form a transferred image thereon.

In a similar manner, a toner which is not transferred and remains on the intermediate transfer roller P18 after the toner image has been transferred to the recording medium F5 is removed by a cleaning blade P23 made of a urethane rubber or the like.

Thereafter, the toner image (transferred image) on the recording medium F5 is fixed thereto using a fixing unit (fixing section) as described below.

Figure 2:
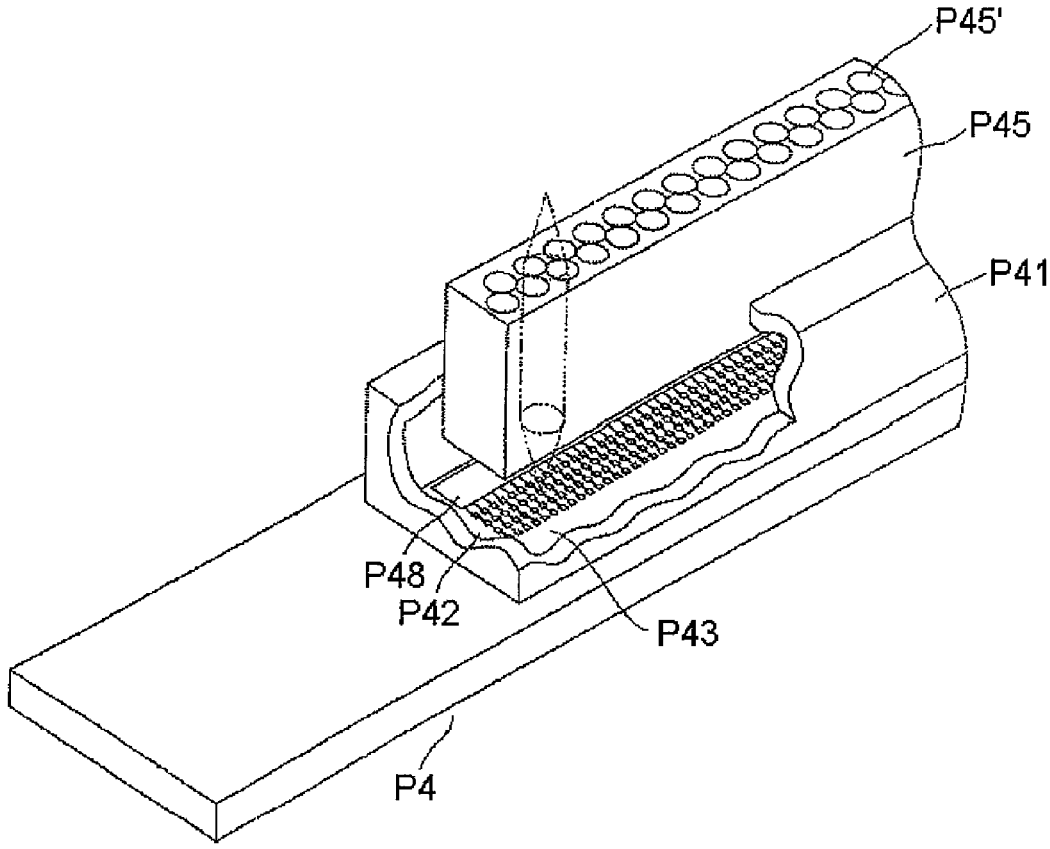
FIG. 2 is a perspective view which shows one example of a line head exposure section provided in the image forming apparatus according to the invention.

Now, the line head exposure section P4 will be described with reference to FIG. 2. FIG. 2 is a schematic perspective view which shows by expanding the line head exposure section P4.

According to the line head exposure section P4, a light emitting element array P42, which has a plurality of organic EL elements, is mounted on a glass board P43, and each of the organic EL elements is driven by a thin film transistor (TFT) P48 similarly formed on the glass board P43.

The refractive index distributing type rod lens array P45 constitutes a focusing optical system and laminated with refractive index distributing type rod lenses P451 arranged at a front face of the light emitting element array P42 layer by layer.

A housing P41 covers a surrounding of the glass board P43 and a side thereof facing the photoreceptor P2 is opened. In this way, light ray is emitted from the refractive index distributing type rod lens P45' to the photoreceptor P2. A face of the housing P41 opposed to an end face of the glass board P43 is provided with a light absorbing member (coating).

Figure 3:
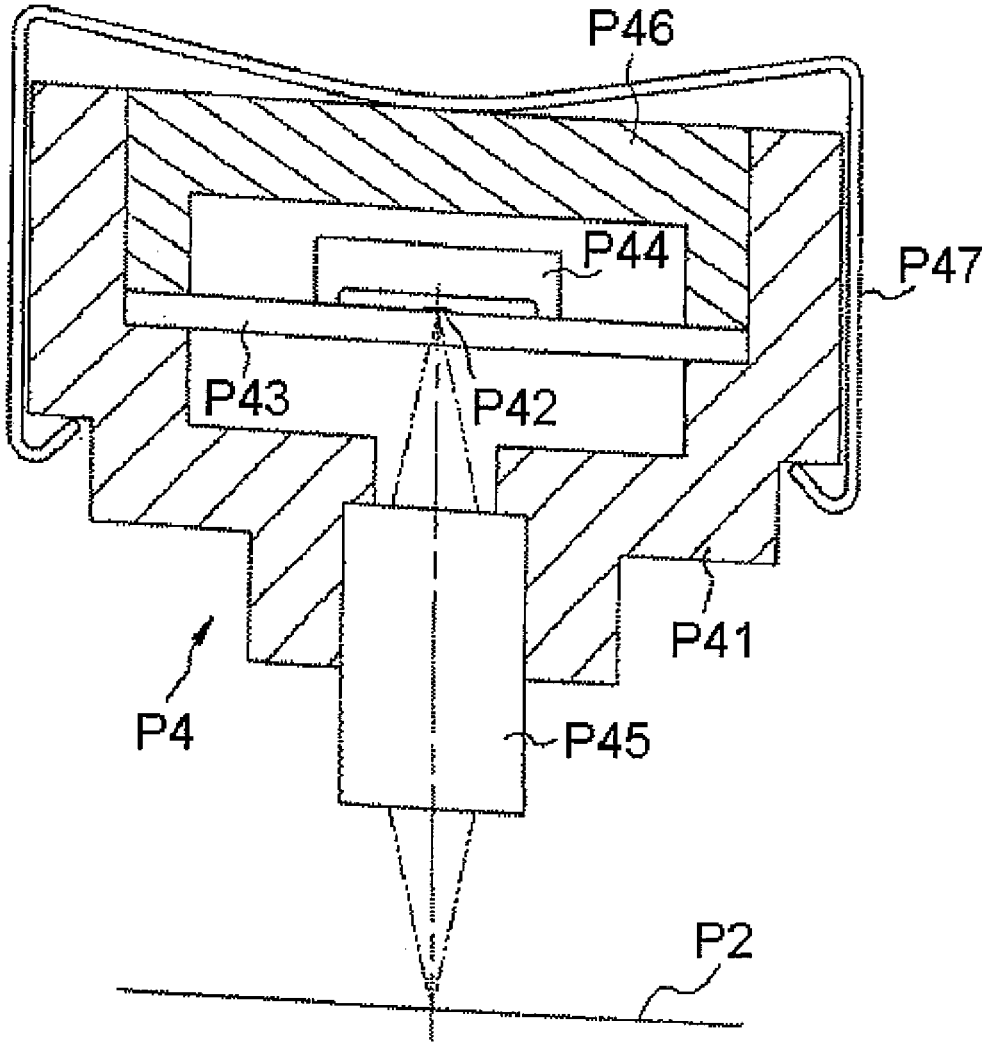
FIG. 3 is a cross sectional view of the line head exposure section taken along a sub-scanning direction thereof.

FIG. 3 is a cross sectional view of the line head exposure section P4 taken along a sub-scanning direction thereof. The line head exposure section P4 is provided with the light emitting element array P42 having the organic EL elements and attached to face the rear face of the refractive index distributing type rod lens array P45 in the housing P41, a sealing member P44 for sealing the light emitting element array P42, and a nontransparent cover P46 for shielding the light emitting element array P42 in the housing P41 from a rear face thereof.

Further, inside of the housing P41 is hermetically closed in light tight by pressing the cover P46 to the back face of the housing P41 by a fixing leaf spring P47. That is the glass board P43 is hermetically shielded optically in the housing P41 by the fixing leaf spring P47.

Therefore, light can be absorbed efficiently by preventing total reflection at the end face of the glass board P43. The fixing leaf springs P47 are provided at a plurality of portions in a longitudinal direction of the housing P41 (illustration thereof is omitted in FIG. 3).

In FIG. 3, a material of absorbing light, for example, synthetic resin of black color polystyrene or the like, aluminum subjected to almite treatment or the like is used for the housing P41 comprising the nontransparent member. Further, the end faces in the thickness direction on the both sides of the glass board P43, that is, the faces of the housing P41 opposed to the end faces in a thickness direction in the sub scanning direction are coated with a black color coating to promote light absorbing property.

In this way, by using the organic EL element as the light emitting element, the light emitting element can easily be formed on the glass board. Therefore, the shape of the light emitting element can be constituted by an arbitrary shape and therefore, low price formation is achieved. Further, by providing such a line head exposure section P4 in the liquid developing unit, an image forming apparatus with inconsiderable deterioration in an image can be provided.

Figure 4:
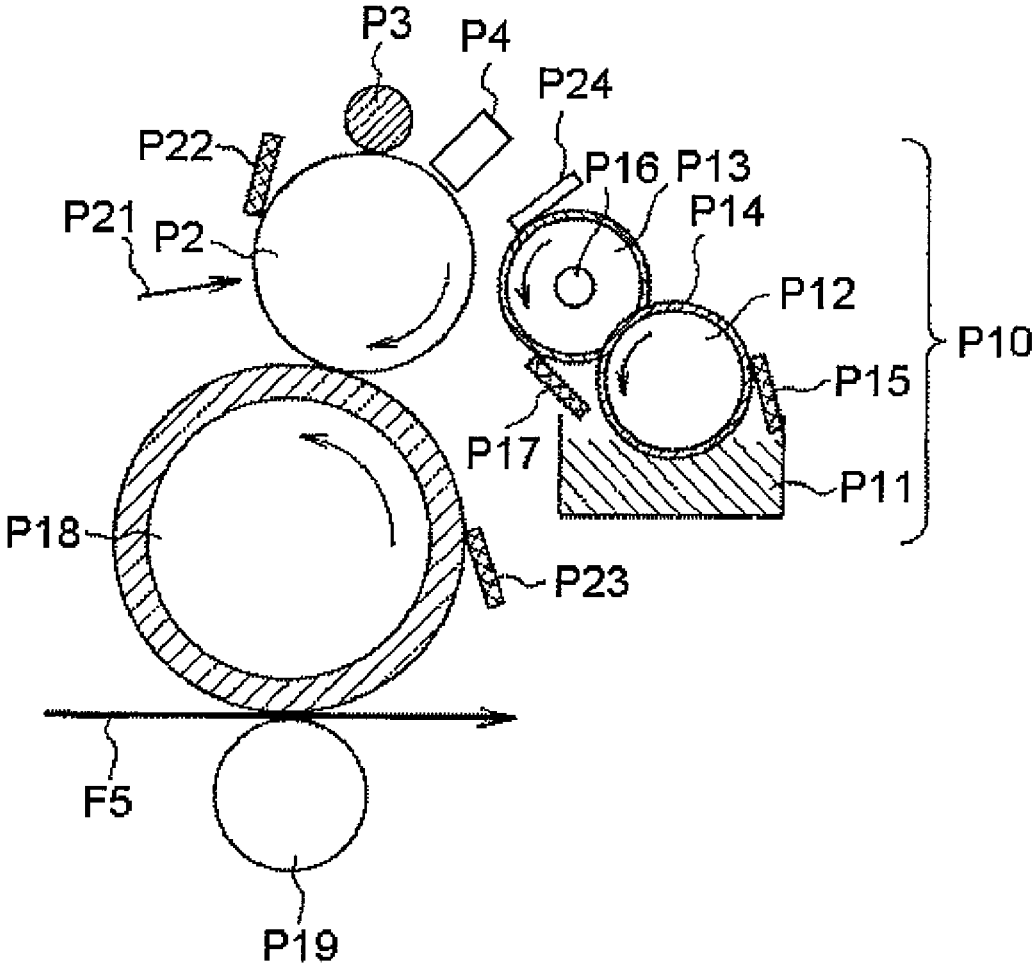
FIG. 4 is a cross sectional view which shows one example of a non-contact type liquid developing unit provided in an image forming apparatus according to the invention.

FIG. 4 is a cross sectional view which shows one example of a non-contact type liquid developing unit provided in an image forming apparatus according to the invention. In such a non-contact type liquid developing unit, a development roller P13 is provided with a charging blade 24 which is formed from a phosphor-bronze plate having a thickness of 0.5 mm.

The charging blade 24 has a function of causing a layer of the liquid developer to be charged by contacting it. Further, since an application roller P12 is a gravure roller, a layer of a developer having irregularities which correspond to irregularities on the surface of the gravure roller is formed on the development roller P13.

The charging blade 24 also has a function of uniforming the irregularities formed on the development roller P13. The orientation of the charging blade 24 is either of a counter direction or a trail direction with respect to the rotational direction of the development roller. Further, the charging blade 24 may be in the form of a roller not a blade.

Preferably, between the development roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the development roller P13 and the photoreceptor P2. Other structures of this non-contact type liquid developing unit are the same as those of the contact type liquid developing unit shown in FIG. 1.

In the foregoing, the description was made with regard to the image formation by the embodiments shown in FIGS. 1 and 4 in which a liquid developer of one color is used. However, it goes without saying that when an image is formed using color toners of a plurality of colors, a color image can be formed by using a plurality of liquid developer storage sections and developing sections corresponding to the respective colors to form images of the respective colors.

Figure 5:
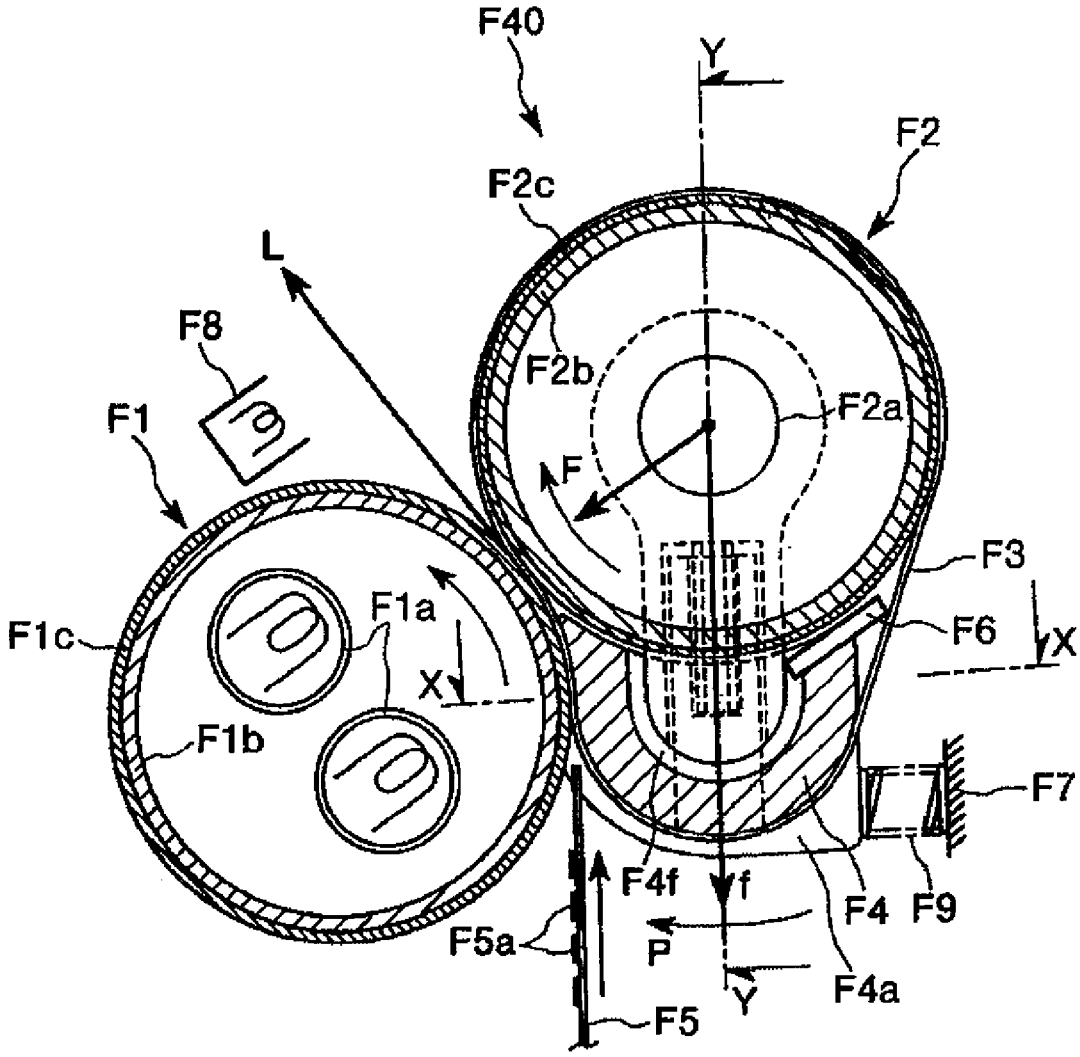
FIG. 5 is a cross-sectional view which shows one example of a fixing unit provided in an image forming apparatus according to the invention.

FIG. 5 is a cross-sectional view which shows one example of a fixing unit provided in an image forming apparatus according to the invention.

As shown in the FIG. 5, the fixing unit (fixing section) F40 is generally composed from a heat fixing roller F1, a pressure roller F2, a heat resistant belt F3, a belt tension member F4, a cleaning member F6, a frame F7, an ultraviolet emitting means F8 and a spring F9.

The heat fixing roller (hereinafter, simply referred to as "fixing roller") F1 has a roller base F1*b* formed from a pipe member, an elastic body F1*c* which covers the outer periphery of the roller base F1*b*, and a pair of halogen lamps F1*a* provided inside the roller base F1. Each of the halogen lamps F1*a* has a columnar shape and acts as a heat source. The heat fixing roller F1 having the above structure is rotatable in an anti-clockwise direction shown by the arrow in the drawing.

Further, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing. On the outer surface of the elastic body F1*c* of the heat fixing roller F1, there is formed a PFA layer.

By composing the heat fixing roller F1 and the pressure roller F2 as mentioned above, even if the thickness of the elastic body F1*c* of the heat fixing roller F1 is different from the thickness of the elastic body F2*c* of the pressure roller F2, the elastic body F1*c* and the elastic body F2*c* are subjected to substantially uniform elastic deformation to form a so-called horizontal nip. Further, since there is no difference between a circumferential velocity of the heat fixing roller F1 and a conveying speed of a heat resistant belt F3 described below or a recording medium F5, it is possible to fix an image in an extremely stable manner.

Further, as described above, inside the heat fixing roller F1, two halogen lamps F1*a*, F1*a* each having a columnar shape and acting as a heat source are provided. These halogen lamps F1*a*, F1*a* are provided with heating elements, respectively, which are arranged at different positions. With this arrangement, by selectively lighting up any one or both of the halogen lamps F1*a*, F1*a*, it is possible to easily carry out a temperature control under different conditions such as a case where a wide recording medium is used or a narrow recording medium is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The pressure roller F2 is arranged so as to face the heat fixing roller F1 so that a pressing pressure is applied against the recording medium F5 on which an unfixed toner image is formed through a heat resistant belt F3. By applying the pressing pressure against the recording medium F5 on which the unfixed toner image, the insulation liquid is impregnated into the recording medium F5 effectively.

By heating the unfixed toner image and emitting ultraviolet rays to the unfixed toner image as mentioned below, the ester-exchange oil and the fatty acid monoester contained in the insulation liquid can be cured more reliably inside the recording medium F5. As a result, the above anchoring effect is created to thereby fix a toner image F5*a* on the recording medium F5 more firmly.

Further, as described above, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing.

The elastic body F1*c* of the heat fixing roller F1 and the elastic body F2*c* of the pressure roller F2 are subjected to substantially uniform elastic deformation to form a so-called horizontal nip. Further, since there is no difference between a circumferential velocity of the heat fixing roller F1 and a conveying speed of a heat resistant belt F3 described below or a recording medium F5, it is possible to fix an image in an extremely stable manner.

The heat resistant belt F3 is a ring-shaped endless belt, and it is would around the outer circumferences of the pressure roller F2 and the belt tension member F4 so that it can be moved with being held between the heat fixing roller F1 and the pressure roller F2 in a pressed state.

The heat resistant belt F3 is formed from a seamless tube having a thickness of 0.03 mm or more. Further, the seamless tube has a two layered structure in which its surface (which is the surface thereof that makes contact with the recording medium F5) is formed of PFA, and the opposite surface thereof (that is, the surface thereof that makes contact with the pressure roller F2 and the belt tension member F4) is formed of polyimide.

However, the structure of the heat resistant belt F3 is not limited to the structure described above, and it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the recording medium F5 conveying direction. Further, the belt tension member F4 is pivotally disposed about the rotation shaft F2*a* of the pressure roller F2 so as to be movable along the arrow P.

The belt tension member F4 is constructed so that the heat resistant belt F3 is extended with tension in the tangential direction of the heat fixing roller F1 in a state that the recording medium F5 does not pass through the fixing nip part. When the fixing pressure is large at an initial position where the recording medium F5 enters the fixing nip part, there is a case that the recording medium F5 can not enter the fixing nip part smoothly and thereby fixation is performed in a state that a tip part of the recording medium F5 is folded.

However, in this embodiment, the belt tension member F4 is provided so that the heat resistant belt F3 is extended with tension in the tangential direction of the heat fixing roller F1 as described above, there is formed an introducing portion for smoothly introducing the recording medium F5, so that the recording medium F5 can be introduced into the fixing nip part in a stable manner.

The belt tension member F4 is a roughly semi-circular member for slidably guiding the heat resistant belt F3 (that is, the heat resistant belt F3 slidably moves on the belt tension member F4). The belt tension member F4 is fitted into the inside of the heat resistant belt F3 so as to impart tension f to the heat resistant belt F3 in cooperation with the pressure roller F2. The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2.

The protruding wall F4*a* is formed on any one or both of the end surfaces of the belt tension member F4 which are located in the axial direction thereof. The protruding wall F4*a* is provided for restricting the heat resistant belt F3 from being off to the side by abutment thereto in a case that the heat resistant belt F3 is deviated in any one of the sides.

Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

A position where the belt tension member F4 is slightly pressed against the heat fixing roller F1 is set as a nip starting position and a position where the pressure roller F2 is pressed against the heat fixing roller F1 is set as a nip ending position.

A linear pressure against the recording medium F5 at the nip ending position, namely a linear pressure of the pressure roller F2 against the recording medium F5 is preferably 500 g/cm or lower, and more preferably 300 g/cm or lower. Even if the linear pressure is set to the above relatively low range, by using the liquid developer of the invention the toner particles can be fixed against the recording medium F5 firmly. Further, by setting the linear pressure to the relatively low range, the heat fixing roller F1 and the pressure roller F2 can drive using low electric power. This makes it possible to reduce energy for driving the fixing unit (image forming apparatus).

In the fixing unit F40, a recording medium F5 on which an unfixed toner image F5*a* is formed using the above liquid developing unit enters into the fixing nip part from the nip starting position, then passes between the heat resistant belt F3 and the heat fixing roller F1, and then exits from the nip ending position, and in this way an unfixed toner image F5*a* formed on the recording medium F5 is fixed. Thereafter, the recording medium 2 on which the toner image is formed is fed out toward the tangential direction L of the pressing potion of the press roller F2 against the heat fixing roller F1.

The ultraviolet emitting means F8 has a function that emits ultraviolet rays to a surface of the recording medium F5 fed out as described above, the surface on which the toner image F5*a* is formed. Thus, by heating the unfixed toner image F5*a* formed on the recording medium F5 by means of the heat fixing roller F1 and then emitting ultraviolet rays toward the unfixed toner image F5*a* from the ultraviolet emitting means F8, the ester-exchange oil and the fatty acid monoester impregnated into the recording medium can be oxidized and polymerized (oxidatively polymerized) reliably.

As a result, the above anchoring effect is created due to the cured ester-exchange oil and the cured fatty acid monoester so that the toner particles can be fixed on the recording medium firmly. By utilizing the oxidation polymerization reaction as described below, the toner particles can be fixed on the recording medium firmly without heating the toner image at especially high temperature by the heat fixing roller F1.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3.

By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3.

However, there is a case that these frictional coefficients become unstable due to entering of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2.

With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in a stable manner.

The time required for the toner particles to pass the fixing nip part (that is, nip time) is preferably in the range of 0.02 to 0.2 seconds, and more preferably 0.03 to 0.1 seconds. Even if the time required for the toner particles to pass the fixing nip part is set to the above short range, by using the liquid developer of the invention the toner particles are fixed against the recording medium F5 sufficiently. This makes it possible to print an image at higher speed.

The temperature for fixing an unfixed toner image is preferably in the range of 80 to 200° C., and more preferably 80 to 180° C. When the fixing temperature is in the above range, the antioxidizing agent as described above can be pyrolyzed easily. As a result, it is possible to increase the fixing strength of the toner particles more effectively.

Further, when the fixing temperature is within the above range, the oxidation polymerization reaction (curing reaction) of the ester-exchange oil and the fatty acid monoester can progress effectively. Such a tendency is exhibited pronouncedly when the oxidation polymerization accelerator is contained in the liquid developer.

Further, by setting the fixing temperature to the above range, deterioration of a pigment and a resin material (resin component) can be suppressed. As a result, a toner image having a desired image quality can be obtained reliably. Especially, in the case where an image is formed using a plurality of color toner particles, a toner image having a desired color tone can be obtained reliably.

In the foregoing, the invention was described based on the preferred embodiments, but the invention is not limited to these embodiments. Further, the liquid developer of the invention is not limited to one that is used in the image forming apparatus as described above.

EXAMPLE

<1> Production of Liquid Developer

Example 1

Production of Toner Particles

First, 80 parts by weight of a polyester resin (softening point $T_f$ thereof was 99° C. and molecular weight thereof was 7500), and parts by weight of a cyanine pigment ("Pigment Blue 15:3", produced by Dainichiseika Color & Chemicals Mfg. Co., Ltd.) as a coloring agent were prepared. These components were mixed using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mil to be formed into powder (ground material) having an average particle size of 1.0 mm or less.

Next, 250 parts by weight of toluene was added to 100 parts by weight of the coarse kneaded material, and then it was subjected to a treatment using an ultrasound homogenizer (output: 400 μA) for one hour to obtain a solution in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid. The water-based liquid was stirred with a homomixer (produced by PRIMIX Corporation) with the number of stirring being adjusted.

The above-mentioned solution (that is, the toluene solution of the kneaded material) was dropped in the water-based liquid with being stirred, to obtain a water-based emulsion in which a dispersoid comprised of particles having an average particle size of 3.0 μm was homogeneously dispersed.

Thereafter, the toluene in the water-based emulsion was removed under the conditions in which a temperature was 100° C. and an ambience pressure was 80 kPa, and then it was cooled to room temperature to thereby obtain a water-based suspension in which solid fine particles were dispersed. In the thus obtained water-based suspension, substantially no toluene remained.

The concentration of the solid component (dispersoid) of the thus obtained water-based suspension was 30.5 wt %. Further, the average particle size of the particles of the dispersoid (solid fine particles) dispersed in the suspension was 1.4 μm.

The measurement of the average particle size was carried out using a laser diffraction/scattering type particle size distribution measurement apparatus ("LA-920", produced by HORIBA Ltd.).

The thus obtained suspension was dried by a spray drying method. As a result, the dispersion medium was removed from droplets of the ejected water-based suspension to thereby obtain dry toner particles.

Preparation of Insulation Liquid

An insulation liquid was prepared as described below.

First, 120 parts by weight of soybean oil ("soybean refined oil", produced by The Nisshin OilliO Group, Ltd., and iodine value thereof was 120), and 90 parts by weight of rapeseed oil (produced by The Nisshin OilliO Group, Ltd., and iodine value thereof was 100) as semidrying oil were prepared.

Next, these oils were mixed, and then were dried under reduced pressure adequately. Then, 1.2 parts by weight of sodium methylate as a catalyst was added to the dried mixture, and the mixture containing the catalyst was stirred for one hour at 100° C. so that an ester-exchange reaction of the soybean oil and the rapeseed oil occurred.

The liquid obtained by the ester-exchange reaction was filtrated in order to remove the catalyst, and then was dried by a reduced-pressure drying method to thereby obtain ester-exchange oil as an insulation liquid.

In this regard, the electric resistance of the thus obtained insulation liquid at room temperature (20° C.) was $2.0\times10^{13}$ Ωcm. Further, the iodine value of the obtained insulation liquid was 111.

Encapsulation

An encapsulated oxidation polymerization accelerator was prepared in the following manner.

First, 10 g of an octylic acid zinc as an oxidation polymerization accelerator was dissolved in 15 ml of acetone, and the thus obtained solution was adsorbed by a porous hydrophilic silica gel to thereby obtain core bodies. Then, 10 g of the thus obtained core bodies and 20 g of polyethylene glycol (PEG) were heated and mixed to thereby obtain a mixture thereof.

Thereafter, the mixture was put into 400 ml of a solvent ("AF6", produced by NIPPON MITSUBISHI OIL CORPORATION), and it was sufficiently dispersed in the solvent with a homomixer, then it was gradually cooled down so that PEG was settled down. Then, the solvent was removed by a filtering member to thereby obtain an encapsulated oxidation polymerization accelerator.

Dispersion of Toner Particles and Oxidation Polymerization Accelerator 505 parts by weight of the thus obtained insulation liquid, 1 part by weight of dodecyltrimethylammonium chloride as a surfactant, 1.25 parts by weight of the encapsulated oxidation polymerization accelerator (where the amount of the oxidation polymerization accelerator was 1 part by weight), and 75 parts by weight of the toner particles were mixed and then stirred with a homomixer (produced by PRIMIX Corporation) for 10 minutes to thereby obtain a liquid developer.

In the obtained liquid developer, the average particle size of the toner particles was 1.4 μm, and the average roundness of the toner particles was 0.96 μm.

Examples 2 to 5

In each of Examples 2 to 5, a liquid developer was produced in the same manner as in the Example 1 except that the amount of the soybean oil and the rapeseed oil was changed to that shown in Table 1.

Example 6

In Example 6, a liquid developer was produced in the same manner as in the Example 1 except that sunflower oil ("high-oleic sunflower oil", produced by Showa Sangyo Co., Ltd., and iodine value thereof was 90) was used as semidrying oil instead of the rapeseed oil.

Example 7

In Example 7, a liquid developer was produced in the same manner as in the Example 1 except that safflower oil ("high-oleic safflower oil", produced by The Nisshin OilliO Group, Ltd., and iodine value thereof was 110) was used as semidrying oil instead of the rapeseed oil.

Example 8

In Example 8, a liquid developer was produced in the same manner as in the Example 1 except that olive oil (produced by The Nisshin OilliO Group, Ltd., and iodine value thereof was 80) was used as nondrying oil instead of the rapeseed oil.

Examples 9 to 12

In each of Examples 9 to 12, a liquid developer was produced in the same manner as in the Example 8 except that the amount of the soybean oil and the olive oil was changed to that shown in Table 1.

Example 13

In Example 13, a liquid developer was produced in the same manner as in the Example 8 except that castor oil (produced by Kokura Synthetic Industries, Ltd., and iodine value thereof was 85) was used as nondrying oil instead of the olive oil.

Example 14

In Example 14, a liquid developer was produced in the same manner as in the Example 8 except that peanut oil (produced by The Nisshin OilliO Group, Ltd., and iodine value thereof was 87) was used as nondrying oil instead of the olive oil.

Comparative Example 1

In Comparative Example 1, a liquid developer was produced in the same manner as in the Example 1 except that ISOPER G was used as an insulation liquid.

Comparative Example 2

In Comparative Example 2, a liquid developer was produced in the same manner as in the Example 1 except that an insulation liquid consisting of the soybean oil was used.

Comparative Example 3

In Comparative Example 3, a liquid developer was produced in the same manner as in the Example 1 except that the ester-exchange reaction of the soybean oil and the rapeseed oil was omitted, and a mixture of the soybean oil and the rapeseed oil was used as an insulation liquid.

Comparative Example 4

In Comparative Example 4, a liquid developer was produced in the same manner as in the Example 8 except that the ester-exchange reaction of the soybean oil and the olive oil was omitted, and a mixture of the soybean oil and the olive oil was used as an insulation liquid.

With respect to the liquid developers of the Examples 1 to 14 and the Comparative Examples 1 to 4, the composition of each of the insulation liquids, and the type of the oils used for the ester-exchange reaction are shown in the following Table 1.

TABLE 1

| | Insulation liquid | | | | | | | |
|---|---|---|---|---|---|---|---|---|
| | Oil used for ester-exchange reaction | | | | | | | |
| | Drying oil | | | Semidrying oil/Nondrying oil | | | | |
| | Kind of oil | Amount [parts by weight] | Iodine value $I_1$ | Kind of oil | Classification of oil | Amount [parts by weight] | Iodine value $I_2$ | Iodine value |
| Ex. 1 | Soybean oil | 120 | 120 | Rapeseed oil | Semidrying oil | 90 | 100 | 111 |
| Ex. 2 | Soybean oil | 90 | 120 | Rapeseed oil | Semidrying oil | 120 | 100 | 109 |
| Ex. 3 | Soybean oil | 60 | 120 | Rapeseed oil | Semidrying oil | 150 | 100 | 106 |
| Ex. 4 | Soybean oil | 150 | 120 | Rapeseed oil | Semidrying oil | 60 | 100 | 114 |
| Ex. 5 | Soybean oil | 180 | 120 | Rapeseed oil | Semidrying oil | 30 | 100 | 117 |
| Ex. 6 | Soybean oil | 120 | 120 | Sunflower oil | Semidrying oil | 90 | 90 | 107 |
| Ex. 7 | Soybean oil | 120 | 120 | Safflower oil | Semidrying oil | 90 | 110 | 116 |
| Ex. 8 | Soybean oil | 120 | 120 | Olive oil | Nondrying oil | 90 | 80 | 103 |
| Ex. 9 | Soybean oil | 90 | 120 | Olive oil | Nondrying oil | 120 | 80 | 97 |
| Ex. 10 | Soybean oil | 60 | 120 | Olive oil | Nondrying oil | 150 | 80 | 91 |
| Ex. 11 | Soybean oil | 150 | 120 | Olive oil | Nondrying oil | 60 | 80 | 109 |
| Ex. 12 | Soybean oil | 180 | 120 | Olive oil | Nondrying oil | 30 | 80 | 114 |
| Ex. 13 | Soybean oil | 120 | 120 | Castor oil | Nondrying oil | 90 | 85 | 105 |
| Ex. 14 | Soybean oil | 120 | 120 | Peanut oil | Nondrying oil | 90 | 87 | 106 |
| Com. Ex. 1 | — | — | — | — | — | — | — | — |
| Com. Ex. 2 | — | — | — | — | — | — | — | 120 |
| Com. Ex. 3 | — | — | — | — | — | — | — | 111 |
| Com. Ex. 4 | — | — | — | — | — | — | — | 103 |

<2> Evaluation

For the respective liquid developers produced as described above, fixing strength and storage stability were evaluated.

<2.1> Fixing Strength

The liquid developers produced in the Examples 1 to 14 and the Comparative Examples 1 to 4 were put into the liquid developing unit as shown in FIG. 1, respectively, and then an unfixed toner image was formed onto a recording medium ("J Paper", produced by Fuji Xerox Office Supply Co., Ltd.).

Next, the unfixed toner image was fixed on the recording medium using the fixing unit as shown in FIG. 5. In this regard, the fixing unit comprised a heat fixing roller and a pressure roller. Further, the heat fixing roller had a cored bar formed from a pipe member and a release layer which covered an outer periphery of the cored bar.

The cored bar was formed from aluminium and had an outer diameter of Φ30 mm, a length of 240 mm and a thickness of 1 mm. Further, the release layer was formed from tetrafluoroetylene-perfluoroalkylvinylether copolymer (PFA) and had a thickness of 30 μm. Furthermore, the pressure roller was formed from heat vulcanizing silicone rubber and had an outer diameter of Φ30 mm, a length of 240 mm and a thickness of 7 mm.

Further, a halogen lamp was provided inside the heat fixing roller as a heat source. The halogen lamp had an emission portion length of 240 mm, a total length of 292 mm and a power of 850 W. A pressure welding force of the pressure roller against the heat fixing roller and a width of a nip were set to 4 kg and about 8 mm, respectively.

A fixing temperature was set to 180° C., and a conveying speed of a recording medium by the fixing unit was set to 30 pieces/min. Further, a high-pressure mercury lamp (power thereof was 100 W/cm$^2$) was used as an ultraviolet emitting means. And a distance between the high-pressure mercury lamp and the recording medium was set to 2 cm.

The fixed toner image on each of the recording mediums was rubbed out twice using a sand eraser ("LION 261-11", produced by LION OFFICE PRODUCTS CORP.) with a pressure loading of 1.0 kgf/cm$^2$. Then, the residual rate of the image density of each recording medium was measured by a calorimeter ("X-Rite model 404", produced by X-Rite Incorporated), and the measurement results were evaluated according to the following five criteria.

AA: Residual rate of the image density was 95% or higher

A: Residual rate of the image density was 90% or higher but lower than 95%

B: Residual rate of the image density was 80% or higher but lower than 90%

C: Residual rate of the image density was 70% or higher but lower than 80%

D: Residual rate of the image density was lower than 70%

<2.2> Storage Stability

The liquid developers obtained in the Examples 1 to 14 and the Comparative Examples 1 to 4 were being placed under the atmosphere at a temperature of 35° C. and a relative humidity of 65% for six months. Thereafter, conditions of the liquid developers were visually observed, and the observation results were evaluated by the following five criteria.

AA: Increased viscosity and color change of the liquid developer were not observed at all.

A: Increased viscosity and color change of the liquid developer were scarcely observed.

B: Increased viscosity and color change of the liquid developer were slightly observed, but the change is a degree that there is not a problem when using the liquid developer.

C: Increased viscosity and color change of the liquid developer were clearly observed.

D: Increased viscosity and color change of the liquid developer were conspicuously observed.

These results are shown in the following Table 2.

TABLE 2

| | Fixing strength | | |
|---|---|---|---|
| | Residual rate of image density [%] | Evaluation | Storage stability |
| Ex. 1 | 96 | AA | AA |
| Ex. 2 | 92 | A | AA |
| Ex. 3 | 92 | A | AA |
| Ex. 4 | 95 | AA | A |
| Ex. 5 | 97 | AA | A |
| Ex. 6 | 96 | AA | AA |
| Ex. 7 | 98 | AA | AA |
| Ex. 8 | 95 | AA | AA |
| Ex. 9 | 91 | A | AA |
| Ex. 10 | 86 | B | AA |
| Ex. 11 | 95 | AA | AA |
| Ex. 12 | 96 | AA | AA |
| Ex. 13 | 96 | AA | AA |
| Ex. 14 | 98 | AA | AA |
| Com. Ex. 1 | 60 | D | B |
| Com. Ex. 2 | 87 | B | D |
| Com. Ex. 3 | 82 | B | C |
| Com. Ex. 4 | 73 | C | C |

As shown in the Table 2, the liquid developers according to the invention (that is, the liquid developers of the Examples 1 to 14) had excellent fixing strength and excellent storage stability. In contrast, in the liquid developers of the Comparative Examples 1 to 4, satisfactory results could not be obtained.

Further, the fixing temperature of the fixing unit was changed and set to 160° C., 140° C., 120° C., 100° C., and 80° C., respectively, and for the respective liquid developers produced in the Examples and the Comparative Examples, the fixing strength was evaluated in the same manner as described above. As a result, substantially the same results could be obtained.

These results show that the liquid developer of the invention is suitable for use in the case where a fixation of the toner particles onto a recording medium is carried out at a low temperature. Further, these results show that a temperature range in which the fixation can be carried out suitably is broad.

Further, the conveying speed of a recording medium by the fixing unit was set to 40 pieces/min, 50 pieces/min, and 60 pieces/min, respectively, in place of 30 pieces/min, and for the respective liquid developers produced in the Examples and the Comparative Examples, the fixing strength was evaluated in the same manner as described above. As a result, substantially the same results could be obtained. These results show that the liquid developer of the invention is suitable for use in the case of a high-speed printing.

Furthermore, liquid developers which are the same as those described above were produced excepting that as a coloring agent a pigment red 122, a pigment yellow 180, and a carbon black ("Printex L", produced by Degussa AG) were used instead of a cyanogen-based pigment, and they were evaluated in the same manner as described above. As a result, substantially the same results could be obtained.

<3> Production of Liquid Developer

Example 15

Production of Toner Particles

First, 80 parts by weight of a polyester resin (softening point $T_f$ thereof was 99° C. and molecular weight thereof was 7500), and parts by weight of a cyanine pigment ("Pigment Blue 15:3", produced by Dainichiseika Color & Chemicals Mfg. Co., Ltd.) as a coloring agent were prepared. These components were mixed using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mil to be formed into powder (ground material) having an average particle size of 1.0 mm or less.

Next, 250 parts by weight of toluene was added to 100 parts by weight of the coarse kneaded material, and then it was subjected to a treatment using an ultrasound homogenizer (output: 400 μA) for one hour to obtain a solution in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid. The water-based liquid was stirred with a homomixer (produced by PRIMIX Corporation) with the number of stirring being adjusted.

The above-mentioned solution (that is, the toluene solution of the kneaded material) was dropped in the water-based liquid with being stirred, to obtain a water-based emulsion in which a dispersoid comprised of particles having an average particle size of 3.0 μm was homogeneously dispersed.

Thereafter, the toluene in the water-based emulsion was removed under the conditions in which a temperature was 100° C. and an ambience pressure was 80 kPa, and then it was cooled to room temperature to thereby obtain a water-based suspension in which solid fine particles were dispersed. In the thus obtained water-based suspension, substantially no toluene remained.

The concentration of the solid component (dispersoid) of the thus obtained water-based suspension was 30.5 wt %. Further, the average particle size of the particles of the dispersoid (solid fine particles) dispersed in the suspension was 1.4 μm.

The measurement of the average particle size was carried out using a laser diffraction/scattering type particle size distribution measurement apparatus ("LA-920", produced by HORIBA Ltd.).

The thus obtained suspension was dried by a spray drying method. As a result, the dispersion medium was removed from droplets of the ejected water-based suspension to thereby obtain dry toner particles Preparation of Insulation Liquid Ester-exchange oil and fatty acid monoester contained in an insulation liquid were prepared as described below.

Preparation of Ester-exchange Oil

First, 120 parts by weight of soybean oil ("soybean refined oil", produced by The Nisshin OilliO Group, Ltd., and iodine value thereof was 120), and 90 parts by weight of rapeseed oil (produced by The Nisshin OilliO Group, Ltd., and iodine value thereof was 100) as semidrying oil were prepared.

Next, these oils were mixed, and then were dried under reduced pressure adequately. Then, 1.2 parts by weight of sodium methylate as a catalyst was added to the dried mixture, and the mixture containing the catalyst was stirred for one hour at 100° C. so that an ester-exchange reaction of the soybean oil and the rapeseed oil occurred.

The liquid obtained by the ester-exchange reaction was filtrated in order to remove the catalyst, and then was dried by a reduced-pressure drying method to thereby obtain ester-exchange oil.

Preparation of Fatty Acid Monoester

Next, an ester-exchange reaction was carried out for soybean oil ("soybean refined oil", produced by The Nisshin OilliO Group, Ltd., and iodine value thereof was 120) and methanol, and then glycerin produced by this reaction was removed to thereby obtain a liquid mainly constituted from fatty acid monoester. Thereafter, by further refining the liquid, soybean oil fatty acid methyl containing fatty acid monoester of 99.9 wt % or higher was obtained.

The thus obtained fatty acid monoester was mainly constituted from unsaturated fatty acid monoester such as methyl oleate, methyl linoleate, α-methyl linoleate, and the like, and saturated fatty acid monoester such as methyl palmitate, methyl stearate, and the like. The amount of the unsaturated fatty acid monoester contained in the fatty acid monoester was 84 wt %.

150 parts by weight of the ester-exchange oil, and 60 parts by weight of the fatty acid monoester were mixed to obtain an insulation liquid. In this regard, the electric resistance of the thus obtained insulation liquid at room temperature (20° C.) was $8.5\times10^{12}$ Ωcm. Further, the iodine value of the obtained insulation liquid was 114.

Encapsulation

An encapsulated oxidation polymerization accelerator was prepared in the following manner.

First, 10 g of an octylic acid zinc as an oxidation polymerization accelerator was dissolved in 15 ml of acetone, and the thus obtained solution was adsorbed by a porous hydrophilic silica gel to thereby obtain core bodies. Then, 10 g of the thus obtained core bodies and 20 g of polyethylene glycol (PEG) were heated and mixed to thereby obtain a mixture thereof.

Thereafter, the mixture was put into 400 ml of a solvent ("AF6", produced by NIPPON MITSUBISHI OIL CORPORATION), and it was sufficiently dispersed in the solvent with a homomixer, then it was gradually cooled down so that PEG was settled down. Then, the solvent was removed by a filtering member to thereby obtain an encapsulated oxidation polymerization accelerator.

Dispersion of Toner Particles and Oxidation Polymerization Accelerator 505 parts by weight of the thus obtained insulation liquid, 1 part by weight of dodecyltrimethylammonium chloride as a surfactant, 1.25 parts by weight of the encapsulated oxidation polymerization accelerator (where the amount of the oxidation polymerization accelerator was 1 part by weight), 1.5 parts by weight of dibutylhydroxytoluene as an antioxidizing agent, and 75 parts by weight of the toner particles were mixed and then stirred with a homomixer (produced by PRIMIX Corporation) for 10 minutes to thereby obtain a liquid developer.

In the obtained liquid developer, the average particle size of the toner particles was 1.4 μm, and the average roundness of the toner particles was 0.96 μm.

Example 16

In Example 16, a liquid developer was produced in the same manner as in the Example 15 except that 202 parts by weight of the ester-exchange oil, and 8 parts by weight of the fatty acid monoester were mixed to obtain an insulation liquid.

Example 17

In Example 17, a liquid developer was produced in the same manner as in the Example 15 except that 195 parts by weight of the ester-exchange oil, and 15 parts by weight of the fatty acid monoester were mixed to obtain an insulation liquid.

Example 18

In Example 18, a liquid developer was produced in the same manner as in the Example 15 except that 170 parts by weight of the ester-exchange oil, and 40 parts by weight of the fatty acid monoester were mixed to obtain an insulation liquid.

Example 19

In Example 19, a liquid developer was produced in the same manner as in the Example 15 except that 125 parts by weight of the ester-exchange oil, and 85 parts by weight of the fatty acid monoester were mixed to obtain an insulation liquid.

Example 20

In Example 20, a liquid developer was produced in the same manner as in the Example 15 except that 100 parts by weight of the ester-exchange oil, and 120 parts by weight of the fatty acidmonoester were mixed to obtain an insulation liquid.

Example 21

In preparing fatty acid monoester, an ester-exchange reaction was carried out for safflower oil ("high-oleic safflower oil", produced by The Nisshin OilliO Group, Ltd., and iodine value thereof was 110) and methanol, and then glycerin produced by this reaction was removed to thereby obtain a liquid mainly constituted from fatty acid monoester. Thereafter, by further refining the liquid, safflower oil fatty acid methyl containing fatty acid monoester of 99.9 wt % or higher was obtained.

In this Example 21, a liquid developer was produced in the same manner as in the Example 15 except that the thus obtained safflower oil fatty acid methyl was used as fatty acid monoester instead of the soybean oil fatty acid methyl.

Example 22

In preparing fatty acid monoester, an ester-exchange reaction was carried out for rapeseed oil (produced by The Nisshin OilliO Group, Ltd., and iodine value thereof was 100) and methanol, and then glycerin produced by this reaction was removed to thereby obtain a liquid mainly constituted from fatty acid monoester. Thereafter, by further refining the liquid, rapeseed oil fatty acid methyl containing fatty acid monoester of 99.9 wt % or higher was obtained.

In this Example 22, a liquid developer was produced in the same manner as in the Example 15 except that the thus obtained rapeseedoil fattyacidmethyl was usedas fatty acid-monoester instead of the soybean oil fatty acid methyl.

Example 23

In preparing fatty acid monoester, an ester-exchange reaction was carried out for olive oil (produced by The Nisshin OilliO Group, Ltd., and iodine value thereof was 80) and methanol, and then glycerin produced by this reaction was removed to thereby obtain a liquid mainly constituted from fatty acid monoester. Thereafter, by further refining the liquid, olive oil fatty acid methyl containing fatty acid monoester of 99.9 wt % or higher was obtained.

In this Example 23, a liquid developer was produced in the same manner as in the Example 15 except that the thus obtained olive oil fatty acid methyl was used as fatty acid monoester instead of the soybean oil fatty acid methyl.

Example 24

In preparing fatty acid monoester, an ester-exchange reaction was carried out for soybean oil and ethanol, and then glycerin produced by this reaction was removed to thereby obtain a liquid mainly constituted from fatty acid monoester. Thereafter, by further refining the liquid, soybean oil fatty acid ethyl containing fatty acid monoester of 99.9 wt % or higher was obtained.

In this Example 24, a liquid developer was produced in the same manner as in the Example 15 except that the thus obtained soybean oil fatty acid ethyl was used as fatty acid monoester instead of the soybean oil fatty acid methyl.

Example 25

In preparing fatty acid monoester, an ester-exchange reaction was carried out for soybean oil and isobutanol, and then glycerin produced by this reaction was removed to thereby obtain a liquid mainly constituted from fatty acid monoester. Thereafter, by further refining the liquid, soybean oil fatty acid isobutyl containing fatty acid monoester of 99.9 wt % or higher was obtained.

In this Example 25, a liquid developer was produced in the same manner as in the Example 15 except that the thus obtained soybean oil fatty acid isobutyl was used as fatty acid monoester instead of the soybean oil fatty acid methyl.

Example 26

In preparing fatty acid monoester, an ester-exchange reaction was carried out for soybean oil and butanol, and then glycerin produced by this reaction was removed to thereby obtain a liquid mainly constituted from fatty acid monoester. Thereafter, by further refining the liquid, soybean oil fatty acid butyl containing fatty acid monoester of 99.9 wt % or higher was obtained.

In this Example 26, a liquid developer was produced in the same manner as in the Example 15 except that the thus obtained soybean oil fatty acid butyl was used as fatty acid monoester instead of the soybean oil fatty acid methyl.

Examples 27 to 30

In each of Examples 27 to 30, a liquid developer was produced in the same manner as in the Example 15 except that the amount of the soybean oil and the rapeseed oil, which were used for the ester-exchange reaction, was changed to that shown in Table 3.

Example 31

In Example 31, a liquid developer was produced in the same manner as in the Example 15 except that ester-exchange oil was prepared by using sunflower oil ("high-oleic sunflower oil", produced by Showa Sangyo Co., Ltd., and iodine value thereof was 90) as semidrying oil instead of the rapeseed oil.

Example 32

In Example 32, a liquid developer was produced in the same manner as in the Example 15 except that ester-exchange oil was prepared by using safflower oil ("high-oleic safflower oil", produced by The Nisshin OilliO Group, Ltd., and iodine value thereof was 110) as semidrying oil instead of the rapeseed oil.

Example 33

In Example 33, a liquid developer was produced in the same manner as in the Example 15 except that ester-exchange oil was prepared by using olive oil (produced by The Nisshin OilliO Group, Ltd., and iodine value thereof was 80) as nondrying oil instead of the rapeseed oil.

Example 34

In Example 34, a liquid developer was produced in the same manner as in the Example 15 except that ester-exchange oil was prepared by using castor oil (produced by Kokura Synthetic Industries, Ltd., and iodine value thereof was 85) as nondrying oil instead of the rapeseed oil.

Example 35

In Example 35, a liquid developer was produced in the same manner as in the Example 15 except that ester-exchange oil was prepared by using peanut oil (produced by The Nisshin OilliO Group, Ltd., and iodine value thereof was 87) as nondrying oil instead of the rapeseed oil.

Example 36

In Example 36, a liquid developer was produced in the same manner as in the Example 15 except that a vitamin C was used as an antioxidizing agent instead of the dibutylhydroxytoluene.

Example 37

In Example 37, a liquid developer was produced in the same manner as in the Example 15 except that a vitamin E was used as an antioxidizing agent instead of the dibutylhydroxytoluene.

Comparative Example 5

In Comparative Example 5, a liquid developer was produced in the same manner as in the Example 15 except that ISOPER G was used as an insulation liquid.

Comparative Example 6

In Comparative Example 6, a liquid developer was produced in the same manner as in the Example 15 except that an insulation liquid consisting of the soybean oil was used.

Comparative Example 7

In Comparative Example 7, a liquid developer was produced in the same manner as in the Example 15 except that the ester-exchange reaction of the soybean oil and the rapeseed oil was omitted, and a mixture of 120 parts by weight of the soybean oil and 90 parts by weight of the rapeseed oil was used as an insulation liquid.

Comparative Example 8

In Comparative Example 8, a liquid developer was produced in the same manner as in the Example 15 except that the ester-exchange reaction of the soybean oil and the olive oil was omitted, and a mixture of 120 parts by weight of the soybean oil and 90 parts by weight of the olive oil was used as an insulation liquid.

Comparative Example 9

In Comparative Example 9, a liquid developer was produced in the same manner as in the Example 15 except that the ester-exchange reaction of the soybean oil and the rapeseed oil was omitted, and a mixture of 85 parts by weight of the soybean oil, 65 parts by weight of the rapeseed oil, and 60 parts by weight of the soybean oil fatty acid methyl was used as an insulation liquid.

Comparative Example 10

In Comparative Example 10, a liquid developer was produced in the same manner as in the Example 15 except that the ester-exchange reaction of the soybean oil and the olive oil was omitted, and a mixture of 85 parts by weight of the soybean oil, 65 parts by weight of the olive oil, and 60 parts by weight of the soybean oil fatty acid methyl was used as an insulation liquid.

Comparative Example 11

In Comparative Example 11, a liquid developer was produced in the same manner as in the Example 15 except that an insulation liquid consisting of the soybean oil fatty acid methyl was used.

With respect to the liquid developers of the Examples 15 to 37 and the Comparative Examples 5 to 11, the composition of each of the insulation liquids, and the type of the oils used for the ester-exchange reaction are shown in the following Table 3. In this regard, the vegetable oils used without the ester-exchange reaction in the Comparative Examples 6 to 10 are shown in the column of "an ester-exchange oil".

TABLE 3

| | Insulation liquid | | | | | | | | |
|---|---|---|---|---|---|---|---|---|---|
| | Ester-exchange oil | | | | | | | | |
| | Drying oil | | | Semidrying oil/Nondrying oil | | | | | |
| | Kind of oil | Amount (Wt %) | Iodine value $I_1$ | Kind of oil | Classification of oil | Amount (Wt %) | Iodine value $I_2$ | Ester-exchange | Amount (Wt %) |
| Ex. 15 | Soybean oil | 41.0 | 120 | Rapeseed oil | Semidrying oil | 30.5 | 100 | YES | 71.4 |
| Ex. 16 | Soybean oil | 54.8 | 120 | Rapeseed oil | Semidrying oil | 41.4 | 100 | YES | 96.2 |
| Ex. 17 | Soybean oil | 52.9 | 120 | Rapeseed oil | Semidrying oil | 40.0 | 100 | YES | 92.9 |
| Ex. 18 | Soybean oil | 46.2 | 120 | Rapeseed oil | Semidrying oil | 34.8 | 100 | YES | 81.0 |
| Ex. 19 | Soybean oil | 33.8 | 120 | Rapeseed oil | Semidrying oil | 25.7 | 100 | YES | 59.5 |
| Ex. 20 | Soybean oil | 24.3 | 120 | Rapeseed oil | Semidrying oil | 18.6 | 100 | YES | 42.9 |
| Ex. 21 | Soybean oil | 41.0 | 120 | Rapeseed oil | Semidrying oil | 30.5 | 100 | YES | 71.4 |
| Ex. 22 | Soybean oil | 41.0 | 120 | Rapeseed oil | Semidrying oil | 30.5 | 100 | YES | 71.4 |
| Ex. 23 | Soybean oil | 41.0 | 120 | Rapeseed oil | Semidrying oil | 30.5 | 100 | YES | 71.4 |
| Ex. 24 | Soybean oil | 41.0 | 120 | Rapeseed oil | Semidrying oil | 30.5 | 100 | YES | 71.4 |
| Ex. 25 | Soybean oil | 41.0 | 120 | Rapeseed oil | Semidrying oil | 30.5 | 100 | YES | 71.4 |
| Ex. 26 | Soybean oil | 41.0 | 120 | Rapeseed oil | Semidrying oil | 30.5 | 100 | YES | 71.4 |
| Ex. 27 | Soybean oil | 10.0 | 120 | Rapeseed oil | Semidrying oil | 61.4 | 100 | YES | 71.4 |
| Ex. 28 | Soybean oil | 20.5 | 120 | Rapeseed oil | Semidrying oil | 51.0 | 100 | YES | 71.4 |
| Ex. 29 | Soybean oil | 51.0 | 120 | Rapeseed oil | Semidrying oil | 20.5 | 100 | YES | 71.4 |
| Ex. 30 | Soybean oil | 61.4 | 120 | Rapeseed oil | Semidrying oil | 10.0 | 100 | YES | 71.4 |
| Ex. 31 | Soybean oil | 41.0 | 120 | Sunflower oil | Semidrying oil | 30.5 | 90 | YES | 71.4 |
| Ex. 32 | Soybean oil | 41.0 | 120 | Safflower oil | Semidrying oil | 30.5 | 110 | YES | 71.4 |
| Ex. 33 | Soybean oil | 41.0 | 120 | Olive oil | Nondrying oil | 30.5 | 80 | YES | 71.4 |
| Ex. 34 | Soybean oil | 41.0 | 120 | Castor oil | Nondrying oil | 30.5 | 85 | YES | 71.4 |
| Ex. 35 | Soybean oil | 41.0 | 120 | Peanut oil | Nondrying oil | 30.5 | 87 | YES | 71.4 |
| Ex. 36 | Soybean oil | 41.0 | 120 | Rapeseed oil | Semidrying oil | 30.5 | 100 | YES | 71.4 |
| Ex. 37 | Soybean oil | 41.0 | 120 | Rapeseed oil | Semidrying oil | 30.5 | 100 | YES | 71.4 |
| Com. Ex. 5 | — | — | — | — | — | — | — | — | 0 |
| Com. Ex. 6 | Soybean oil | 100 | 120 | — | — | — | — | — | 100 |
| Com. Ex. 7 | Soybean oil | 57.1 | 120 | Rapeseed oil | Semidrying oil | 42.9 | 100 | NO | 100 |
| Com. Ex. 8 | Soybean oil | 57.1 | 120 | Olive oil | Nondrying oil | 42.9 | 80 | NO | 100 |
| Com. Ex. 9 | Soybean oil | 41.0 | 120 | Rapeseed oil | Semidrying oil | 30.5 | 100 | NO | 71.4 |
| Com. Ex. 10 | Soybean oil | 41.0 | 120 | Olive oil | Nondrying oil | 30.5 | 80 | NO | 71.4 |
| Com. Ex. 11 | — | — | — | — | — | — | — | — | 0 |

| | Insulation liquid | | | | |
|---|---|---|---|---|---|
| | Fatty acid monoester | | | | |
| | Kind of oil | Amount (Wt %) | Unsaturated fatty acid (Wt %) | Iodine value $I_3$ | Iodine value |
| Ex. 15 | Soybean oil fatty acid methyl | 28.6 | 84 | 120 | 114 |
| Ex. 16 | Soybean oil fatty acid methyl | 3.8 | 84 | 120 | 112 |
| Ex. 17 | Soybean oil fatty acid methyl | 7.1 | 84 | 120 | 112 |
| Ex. 18 | Soybean oil fatty acid methyl | 19.0 | 84 | 120 | 113 |
| Ex. 19 | Soybean oil fatty acid methyl | 40.5 | 84 | 120 | 115 |
| Ex. 20 | Soybean oil fatty acid methyl | 57.1 | 84 | 120 | 116 |
| Ex. 21 | Safflower oil fatty acid methyl | 28.6 | 82 | 110 | 111 |
| Ex. 22 | Rapeseed oil fatty acid methyl | 28.6 | 91 | 100 | 108 |
| Ex. 23 | Olive oil fatty acid methyl | 28.6 | 85 | 80 | 102 |
| Ex. 24 | Soybean oil fatty acid ethyl | 28.6 | 84 | 118 | 113 |
| Ex. 25 | Soybean oil fatty acid isobutyl | 28.6 | 84 | 114 | 112 |
| Ex. 26 | Soybean oil fatty acid butyl | 28.6 | 84 | 114 | 112 |
| Ex. 27 | Soybean oil fatty acid methyl | 28.6 | 84 | 120 | 108 |
| Ex. 28 | Soybean oil fatty acid methyl | 28.6 | 84 | 120 | 110 |
| Ex. 29 | Soybean oil fatty acid methyl | 28.6 | 84 | 120 | 116 |

TABLE 3-continued

| | | | | | |
|---|---|---|---|---|---|
| Ex. 30 | Soybean oil fatty acid methyl | 28.6 | 84 | 120 | 118 |
| Ex. 31 | Soybean oil fatty acid methyl | 28.6 | 84 | 120 | 111 |
| Ex. 32 | Soybean oil fatty acid methyl | 28.6 | 84 | 120 | 117 |
| Ex. 33 | Soybean oil fatty acid methyl | 28.6 | 84 | 120 | 108 |
| Ex. 34 | Soybean oil fatty acid methyl | 28.6 | 84 | 120 | 109 |
| Ex. 35 | Soybean oil fatty acid methyl | 28.6 | 84 | 120 | 112 |
| Ex. 36 | Soybean oil fatty acid methyl | 28.6 | 84 | 120 | 114 |
| Ex. 37 | Soybean oil fatty acid methyl | 28.6 | 84 | 120 | 114 |
| Com. Ex. 5 | — | — | — | — | — |
| Com. Ex. 6 | — | — | — | — | 120 |
| Com. Ex. 7 | — | — | — | — | 111 |
| Com. Ex. 8 | — | — | — | — | 103 |
| Com. Ex. 9 | Soybean oil fatty acid methyl | 28.6 | 84 | 120 | 114 |
| Com. Ex. 10 | Soybean oil fatty acid methyl | 28.6 | 84 | 120 | 108 |
| Com. Ex. 11 | Soybean oil fatty acid methyl | 100.0 | 84 | 120 | 120 |

<4> Evaluation

For the respective liquid developers obtained as described above, fixing strength and storage stability were evaluated.

<4.1> Fixing Strength

The liquid developers produced in the Examples 15 to 37 and the Comparative Examples 5 to 11 were put into the liquid developing unit as shown in FIG. 1, respectively, and then an unfixed toner image was formed onto a recording medium ("J Paper", produced by Fuji Xerox Office Supply Co., Ltd.).

Next, the unfixed toner image was fixed on the recording medium using the fixing unit as shown in FIG. 5. In this regard, the fixing unit comprised a heat fixing roller and a pressure roller. Further, the heat fixing roller had a cored bar formed from a pipe member and a release layer which covered an outer periphery of the cored bar.

The cored bar was formed from aluminium and had an outer diameter of Φ30 mm, a length of 240 mm and a thickness of 1 mm. Further, the release layer was formed from tetrafluoroetylene-perfluoroalkylvinylether copolymer (PFA) and had a thickness of 30 μm. Furthermore, the pressure roller was formed from heat vulcanizing silicone rubber and had an outer diameter of Φ30 mm, a length of 240 mm and a thickness of 7 mm.

Further, a halogen lamp was provided inside the heat fixing roller as a heat source. The halogen lamp had an emission portion length of 240 mm, a total length of 292 mm and a power of 850 W. A pressure welding force of the pressure roller against the heat fixing roller and a width of a nip were set to 4 kg and about 8 mm, respectively.

A fixing temperature was set to 160° C., and a conveying speed of a recording medium by the fixing unit was set to 30 pieces/min. Further, a high-pressure mercury lamp (power thereof was 100 W/cm$^2$) was used as an ultraviolet emitting means. And a distance between the high-pressure mercury lamp and the recording medium was set to 2 cm.

The fixed toner image on each of the recording mediums was rubbed out twice using a sand eraser ("LION 261-11", produced by LION OFFICE PRODUCTS CORP.) with a pressure loading of 1.3 kgf/cm$^2$. Then, the residual rate of the image density of each recording paper was measured by a colorimeter ("X-Rite model 404", produced by X-Rite Incorporated), and the measurement results were evaluated according to the following five criteria.

AA: Residual rate of the image density was 95% or higher

A: Residual rate of the image density was 90% or higher but lower than 95%

B: Residual rate of the image density was 80% or higher but lower than 90%

C: Residual rate of the image density was 70% or higher but lower than 80%

D: Residual rate of the image density was lower than 70%

<4.2> Storage Stability

The liquid developers obtained in the Examples 15 to 37 and the Comparative Examples 5 to 11 were being placed under the atmosphere at a temperature of 30° C. and a relative humidity of 65% for six months. Thereafter, conditions of the toner particles in the liquid developers were visually observed, and the observation results were evaluated by the following five criteria.

AA: Increased viscosity and color change of the liquid developer were not observed at all.

A: Increased viscosity and color change of the liquid developer were scarcely observed.

B: Increased viscosity and color change of the liquid developer were slightly observed, but the change is a degree that there is not a problem when using the liquid developer.

C: Increased viscosity and color change of the liquid developer were clearly observed.

D: Increased viscosity and color change of the liquid developer were conspicuously observed.

<4.3> Affects on the components of the liquid developing unit due to contact with the insulation liquid Components provided in the liquid developing unit as shown in FIG. 1 and made contact with the liquid developer were prepared. These components were immersed into the respective liquid developers produced in the Examples 15 to 37 and the Comparative Examples 5 to 11, and then the liquid developers in this state were being placed under the atmosphere in which temperature was in the range of 20 to 28° C. for six months.

Thereafter, surfaces of the respective components were visually observed, and the observation results were evaluated by the following four criteria. In this regard, it is to be noted that developing rollers formed from nitrile-butadiene rubber were subjected to this evaluation test as the components.

A: Swelling or erosion in the vicinity of a surface of the component was not observed.

B: Swelling or erosion in the vicinity of a surface of the component was scarcely observed.

C: Swelling or erosion in the vicinity of a surface of the component was slightly observed.

D: Swelling or erosion in the vicinity of a surface of the component was clearly observed.

These results are shown in the following Table 4.

TABLE 4

| | Fixing strength | | | Immersion test |
|---|---|---|---|---|
| | Residual rate of image density (%) | Evaluation | Storage stability | evaluation of component of liquid developing unit |
| Ex. 15 | 96 | AA | AA | A |
| Ex. 16 | 89 | B | AA | A |
| Ex. 17 | 92 | A | AA | A |
| Ex. 18 | 94 | A | AA | A |
| Ex. 19 | 97 | AA | AA | A |
| Ex. 20 | 98 | AA | A | B |
| Ex. 21 | 94 | A | AA | A |
| Ex. 22 | 96 | AA | AA | A |
| Ex. 23 | 95 | AA | AA | A |
| Ex. 24 | 95 | AA | AA | A |
| Ex. 25 | 94 | A | AA | A |
| Ex. 26 | 96 | AA | AA | A |
| Ex. 27 | 90 | A | AA | A |
| Ex. 28 | 91 | A | AA | A |
| Ex. 29 | 96 | AA | A | A |
| Ex. 30 | 95 | AA | A | A |
| Ex. 31 | 94 | A | AA | A |
| Ex. 32 | 93 | A | AA | A |
| Ex. 33 | 95 | AA | AA | A |
| Ex. 34 | 94 | A | AA | A |
| Ex. 35 | 95 | AA | AA | A |
| Ex. 36 | 95 | AA | A | A |
| Ex. 37 | 96 | AA | A | A |
| Com. Ex. 5 | 50 | D | B | B |
| Com. Ex. 6 | 76 | C | D | A |
| Com. Ex. 7 | 73 | C | C | A |
| Com. Ex. 8 | 58 | D | C | A |
| Com. Ex. 9 | 84 | B | D | A |
| Com. Ex. 10 | 76 | C | D | A |
| Com. Ex. 11 | 96 | AA | D | D |

As shown in the Table 4, the liquid developers according to the invention (that is, the liquid developers of the Examples 15 to 37 each containing the fatty acid monoester) had excellent fixing strength and excellent storage stability. In contrast, in the liquid developers of the Comparative Examples 5 to 11, satisfactory results could not be obtained.

Further, although the fixing strength evaluation test <4.1> was carried out under stricter conditions than that of the fixing strength evaluation test <2.1>, the liquid developers of the Examples 15 to 37 containing fatty acid monoester had especially excellent fixing strength.

Further, the fixing temperature of the fixing unit was changed and set to 180° C., 140° C., 120° C., 100° C., and 80° C., respectively, and for the respective liquid developers produced in the Examples and the Comparative Examples, the fixing strength was evaluated in the same manner as described above. As a result, substantially the same results could be obtained.

These results show that the liquid developer of the invention is suitable for use in the case where a fixation of the toner particles onto a recording medium is carried out at a low temperature. Further, these results show that a temperature range in which the fixation can be carried out suitably is broad.

Further, the conveying speed of a recording medium by the fixing unit was set to 40 pieces/min, 50 pieces/min, and 60 pieces/min, respectively, in place of 30 pieces/min, and for the respective liquid developers produced in the Examples and the Comparative Examples, the fixing strength was evaluated in the same manner as described above. As a result, substantially the same results could be obtained. These results show that the liquid developer of the invention is suitable for use in the case of a high-speed printing.

Furthermore, liquid developers which are the same as those described above were produced excepting that as a coloring agent a pigment red 122, a pigment yellow 180, and a carbon black ("Printex L", Produced by Degussa AG) were used instead of a cyanogen-based pigment, and they were evaluated in the same manner as described above. As a result, substantially the same results could be obtained.

Further, two point characters were printed out using the respective liquid developers of the invention in the same manner as described above. As a result, sharp characters could be printed out.

Finally, it is to be noted that the present invention is not limited to the embodiments and the examples described above, and many additions and modifications may be made without departing from the spirit of the present invention which is defined by the following claims.

What is claimed is:

1. A liquid developer, comprising:

toner particles formed of a resin material and a coloring agent; and an insulation liquid in which the toner particles are dispersed, the insulation liquid containing ester-exchange oil obtained by an ester-exchange reaction of soybean oil and at least one of semidrying oil and nondrying oil and fatty acid monoester, wherein the amount of the fatty acid monoester contained in the insulation liquid is in the range of 5 to 50 wt %.

2. The liquid developer as claimed in claim 1, wherein when X (wt %) represents the amount of the ester-exchange oil contained in the insulation liquid and Y (wt %) represents the amount of the fatty acid monoester contained in the insulation liquid, a relation of $1.0 \leqq X/Y \leqq 5.0$ is satisfied.

3. The liquid developer as claimed in claim 1, wherein the fatty acid monoester contains ester of fatty acid and alkylalcohol having 1 to 4 carbon atoms.

4. The liquid developer as claimed in claim 1, wherein the mixing ratio of the soybean oil and the semidrying oil in the ester-exchange reaction is in the range of 100:5 to 100:500 by weight.

5. The liquid developer as claimed in claim 1, wherein the mixing ratio of the soybean oil and the nondrying oil in the ester-exchange reaction is in the range of 100:5 to 100:300 by weight.

6. The liquid developer as claimed in claim 1, wherein the semidrying oil contains sunflower oil, rapeseed oil or safflower oil.

7. The liquid developer as claimed in claim 1, wherein the nondrying oil contains olive oil, castor oil or peanut oil.

8. The liquid developer as claimed in claim 1, wherein an iodine value of the insulation liquid is in the range of 30 to 220.

9. The liquid developer as claimed in claim 1 further comprises an antioxidizing agent.

10. The liquid developer as claimed in claim 1 further comprises an oxidation polymerization accelerator for accelerating an oxidation polymerization reaction of the ester-exchange oil.

11. The liquid developer as claimed in claim 10, wherein the oxidation polymerization accelerator is contained in the insulation liquid with being encapsulated.

12. An image forming apparatus, comprising:

a liquid developer storage section for storing a liquid developer therein;

a developing section for developing an image using the liquid developer supplied from the liquid developer storage section;

an transfer section for transferring the image formed on the developing section onto a recording medium to form a transferred image thereon; and a fixing section for fixing the transferred image formed on the recording medium onto the recording medium, wherein the liquid developer comprises an insulation liquid containing ester-exchange oil obtained by an ester-exchange reaction of soybean oil and at least one of semidrying oil and nondrying oil and fatty acid monoester, wherein the amount of the fatty acid monoester contained in the insulation liquid is in the range of 5 to 50 wt %, and toner particles dispersed in the insulation liquid.

* * * * *